US007057479B2

(12) United States Patent
Furuya et al.

(10) Patent No.: US 7,057,479 B2
(45) Date of Patent: Jun. 6, 2006

(54) DIELECTRIC FILTER

(75) Inventors: Hiroyuki Furuya, Nara (JP); Akira Enokihara, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/165,274

(22) Filed: Jun. 24, 2005

(65) Prior Publication Data

US 2005/0237134 A1 Oct. 27, 2005

Related U.S. Application Data

(63) Continuation of application No. PCT/JP03/16703, filed on Dec. 25, 2003.

(30) Foreign Application Priority Data

Dec. 26, 2002 (JP) ..... 2002-377057
Apr. 17, 2003 (JP) ..... 2003-113067

(51) Int. Cl.
*H01P 1/20* (2006.01)
*H01P 7/10* (2006.01)

(52) U.S. Cl. ..... 333/202; 333/219.1

(58) Field of Classification Search ..... 333/202, 333/219, 219.1
See application file for complete search history.

(56) References Cited

U.S. PATENT DOCUMENTS 4,706,052 A * 11/1987 Hattori et al. ..... 333/219.1
6,020,800 A 2/2000 Arakawa et al.
2003/0030515 A1 2/2003 Song et al.
2004/0075923 A1 4/2004 Knobloch et al.

FOREIGN PATENT DOCUMENTS

| | | |
|---|---|---|
| JP | 36-18615 | 10/1961 |
| JP | 61-212101 | 9/1986 |
| JP | 10-93311 | 4/1998 |
| JP | 10-290104 | 10/1998 |
| JP | 10-290109 | 10/1998 |
| JP | 2002-111330 | 4/2002 |
| WO | WO 200148856 A1 * | 7/2001 |
| WO | WO 02/05291 A2 | 1/2002 |

OTHER PUBLICATIONS

Akira Enokihara et al., "26-GHz TM11 δ Rectangular-Mode Dielectric Resonator Filter," Technical Report of the RSSJ (RS01-16), Mar. 13, 2003, pp. 1-16, The Radiation Science Society of Japan (with English Translation).
Akira Enokihara et al., "26-GHz TM11 δ Rectangular-Mode Dielectric Resonator Filter," Technical Report of the RSSJ (RS01-16), Mar. 13, 2002, pp. 1-13, The Radiation Science Society of Japan (with English Translation).

* cited by examiner

*Primary Examiner*—Seungsook Ham
(74) *Attorney, Agent, or Firm*—McDermott Will & Emery LLP

(57) ABSTRACT

A dielectric filter is provided with a dielectric multilayer structure formed by layering two or more dielectric layers which have different relative permittivities, at least one feeding electrode formed between any dielectric layers or formed inside of any dielectric layers of the dielectric multilayer structure, and a shield portion that covers the outer surface of the dielectric multilayer structure and is made of a conductive material placed so as to fit on the outer surface without any gap.

2 Claims, 36 Drawing Sheets

DIELECTRIC FILTER

REFERENCE TO RELATED APPLICATION

This Application is a continuation of International Application No. PCT/JP2003/016703, whose international filing date is Dec. 25, 2003, which in turn claims the benefit of Japanese Application No. 2002-377057, filed on Dec. 26, 2002 and Japanese Application No. 2003-113067, filed on Apr. 17, 2003, the disclosures of which Applications are incorporated by reference herein. The benefit of the filing and priority dates of the International and Japanese Applications is respectfully requested.

TECHNICAL FIELD

The present invention relates to a dielectric filter formed by layering a plurality of dielectric layers.

BACKGROUND ART

Conventionally, such a dielectric filter is used as a filter for the microwave band and the millimeter-wave band, and, in particular, a waveguide type filter in which a structure is provided in its waveguide or a dielectric resonator filter is often used. FIG. 23 shows perspective views of a waveguide type filter 101 as one example of the waveguide type filter.

As shown in FIG. 23B, the waveguide type filter 101 obtains a filter characteristic by placing a metal plate 104 where a plurality of windows 104*a* are formed between separate waveguides 102 and 103 that have mutually paired shapes and are able to internally form one waveguide by being joined together, joining the waveguides together, and positioning the windows 104*a* in the waveguide as shown in FIG. 23A. Such a waveguide type filter 101 has the features that it is a transmission line of low loss particularly in the millimeter-wave band (30 to 300 GHz) and the Q value (Quality Factor) of the resonator is also large. On the contrary, there is a problem that the size reduction of the waveguide type filter 101 is difficult because a waveguide-to-microstrip conversion is needed when power is fed by a microstrip line.

Moreover, in the dielectric resonator filter, by placing a filter element formed of a dielectric in a housing made of a metal and feeding powder directly by means of a waveguide or feeding power by means of a microstrip line or the like, electromagnetic waves at the desired frequency are made to resonate in the metal housing, and electromagnetic waves at the desired frequency are taken out.

Conventionally, the dielectric resonator filter of the type that feeds power by means of a microstrip line, which is able to be reduced in size and surface mounted on a circuit board, conversely has a defect that its Q value is small (refer to, for example, Akira Enokihara and three others, "26-GHz band TM11δ-mode dielectric resonator filter", Mar. 13, 2002, The Radiation Science Society of Japan, Technical Report (RS01-16).

On the other hand, a dielectric filter, which employs a dielectric multilayer structure formed by layering a plurality of dielectrics as the filter element, is known, and it is practical to alternately bond and layer two different types of dielectric ceramic materials with an epoxy adhesive to produce a waveguide type short-circuiter (refer to, for example, Japanese patent publication No. H10-290109 A). The above dielectric filter is an example in which a dielectric multilayer mirror that utilizes multiple reflection used in optics is applied to the millimeter-wave band.

DISCLOSURE OF INVENTION

However, the filter has a characteristic such that the cutoff wavelength becomes smaller as the wavelength becomes shorter particularly in the millimeter-wave band. With this characteristic, the dielectric resonator filter and the dielectric filter can be reduced in size to a certain extent. On the contrary, there is a problem that a high dimensional accuracy is required and then the manufacturing and adjustment of the dielectric filter become very difficult.

Moreover, there is a problem of a limit in reducing the size of, in particular, the dielectric resonator filter because it has a metal housing, possibly leading to limitations in design.

For example, in a millimeter-wave band (60 GHz) filter 201 that utilizes the $TM_{01\delta}$ rectangular mode of one example of the dielectric resonator filter as shown in FIG. 24, each of the dielectric resonators 207, which are employed as filters and placed inside, has a size of about 1 mm high×1 mm wide×3 mm long and is provided inside a shield housing 202 that has a cross-sectional shape of about 1.5 mm×1.5 mm. Therefore, spacing between each of the dielectric resonators 207 and the shield housing 202 has a narrow dimension of about 0.25 mm, and interspace (interstage) between the dielectric resonators 207 that are arranged mutually adjacently is also narrow. On the other hand, each of microstrip lines 206 and 205 formed on respective ceramic boards 203 and 204 has a line width of about 0.2 mm, and the positional accuracy of each of the microstrip lines 206 and 205 with respect to the respective ceramic boards 203 and 204 needs to have an accuracy of about 10 μm. Furthermore, the millimeter-wave band filter 201, which has a three-dimensional structure, is hard to manufacture by using semiconductor processes very appropriate for the formation of a minute planar structure, and a problem that the assembling and adjustment of the filter become difficult is expected to occur with a frequency increases in future.

Accordingly, an object of the present invention is to solve the above problems and provide a dielectric filter, which is easily manufactured obviating the need for processing the dielectric and the housing that require a very high processing accuracy and is able to be directly mounted on a circuit formation body by provided an electrode in the dielectric.

In accomplishing the above object, the present invention is constructed as follows.

According to a first aspect of the present invention, there is provided a dielectric filter comprising:

a dielectric multilayer structure formed by layering two or more dielectric layers which have different relative permittivities; and a shield portion that covers an outer surface of the dielectric multilayer structure, is made of a conductive material, and is placed so as to fit on the outer surface without interposition of a gap.

Moreover, the dielectric multilayer structure can be further provided with a waveguide that is placed so as to roughly closely fit on the inside thereof.

Moreover, a shield portion made of a metal so as to cover at least part of the outer surface of the dielectric multilayer structure can be further provided.

Moreover, at least part of a gap generated between the waveguide and the dielectric multilayer structure can be filled with a conductive material.

According to a second aspect of the present invention, there is provided the dielectric filter as defined in the first aspect, further comprising at least one feeding electrode formed between any dielectric layers or inside of any dielectric layer of the dielectric multilayer structure.

According to a third aspect of the present invention, there is provided the dielectric filter as defined in the first aspect, wherein a difference between the different relative permittivities is at least not smaller than ten.

According to a fourth aspect of the present invention, there is provided the dielectric filter as defined in the first aspect, wherein the mutually adjoining dielectric layers are joined (or closely fit) together.

According to a fifth aspect of the present invention, there is provided the dielectric filter as defined in the first aspect, wherein the dielectric layers are made of a dielectric ceramic material whose sintering temperature is not lower than 800° C. and not higher than 1000° C.

According to a sixth aspect of the present invention, there is provided the dielectric filter as defined in the first aspect, wherein the dielectric layers are made of a resin mixed with a dielectric ceramic material.

According to a seventh aspect of the present invention, there is provided the dielectric filter as defined in the first aspect, wherein the feeding electrode is made of a material of silver, copper, gold or palladium or an alloy of the materials.

According to an eighth aspect of the present invention, there is provided the dielectric filter as defined in the first aspect, wherein each of the dielectric layers has a thickness with inclinatorily changed.

According to a ninth aspect of the present invention, there is provided the dielectric filter as defined in the eight aspect, wherein the thickness is inclinatorily changed so that a minimum value of the thickness is not smaller than 70% of a maximum value of the thickness.

According to a tenth aspect of the present invention, there is provided the dielectric filter as defined in the first aspect, wherein the dielectric filter is a filter for use in a microwave band or a filter for use in a millimeter-wave band, and each of the dielectric layers has a product of a thickness dimension and a square root of the relative permittivity of the layer, the product being a value of an integral multiple of a quarter of a wavelength of microwaves or millimeter-waves upon entering the dielectric multilayer structure, and at least one dielectric layer of the dielectric layers has a product of a thickness dimension and a square root of the relative permittivity of the layer, the product being a value of an integral multiple of a half of the wavelength.

According to an eleventh aspect of the present invention, there is provided the dielectric filter as defined in the second aspect, wherein the feeding electrode comprises:

a rectangular member that extends so as to be roughly perpendicular to a layering direction of the dielectric multilayer structure and is placed inside of the dielectric multilayer structure; and a columnar member that is placed roughly perpendicular to the layering direction and the direction in which the rectangular member extends, the columnar member has one end which is exposed outside of the dielectric multilayer structure and the other end which is placed so as to connect with the rectangular member inside of the dielectric multilayer structure.

According to a twelfth aspect of the present invention, there is provided the dielectric filter as defined in the eleventh aspect, wherein the other end of the columnar member has a roughly circumferential end portion, and the rectangular member has end portions that include tangential lines arranged mutually parallel roughly on the circumference and are arranged so as to be roughly perpendicular to the layering direction and an axis of the columnar member.

According to a thirteenth aspect of the present invention, there is provided the dielectric filter as defined in the twelfth aspect, wherein the rectangular member is a flat plate member that further comprises a joint portion for joining the end portions together.

According to a fourteenth aspect of the present invention, a dielectric filter manufacturing method comprising:

layering two or more dielectric layers which have different relative permittivities so that at least one feeding electrode is placed between any dielectric layers, and forming a dielectric multilayer structure of the dielectric layers by sintering the dielectric layers at any temperature within a range of 800° C. to 1000° C. while pressurizing the dielectric layers is provided.

According to a fifteenth aspect of the present invention, the dielectric filter manufacturing method as defined in the thirteenth aspect, in which the mutually layered dielectric layers are press fit together and thereafter the dielectric layers are sintered, is provided.

According to a sixteenth aspect of the present invention, the dielectric filter manufacturing method as defined in the fourteenth aspect or the fifteenth aspect, in which the dielectric multilayer structure is placed in a waveguide, and at least part of a gap generated between the waveguide and the dielectric multilayer structure is filled with a conductive material, is provided.

According to the first aspect of the present invention, the dielectric multilayer structure is formed by layering two or more dielectric layers of different relative permittivities. With this arrangement, it is possible to determine the thickness of each of the dielectric layers by using the principle of multiple reflection in optics and provide the dielectric multilayer structure with the characteristics of the bandpass filter that passes only the frequencies in a prescribed wavelength band.

Moreover, the shield portion that covers the outer surface of the dielectric multilayer structure and is made of a conductor is further provided. With this arrangement, the radiation of microwaves, millimeter-waves or the like from the dielectric multilayer structure transmitted through the dielectric multilayer structure or reflected without being transmitted can be limited by the shield portion. Moreover, for example, when the shield portion is a waveguide in which the dielectric multilayer structure can be located, the dielectric filter is allowed to be used as a waveguide type dielectric filter and also cope with the conventional use of the dielectric filter.

Furthermore, by virtue of the shield portion placed fit to the outer surface of the dielectric multilayer structure without any interspace (gap) in addition to the effects of the above aspects, the filter characteristics of the dielectric filter can be prevented from being influenced by the existence of the gap, and the quality of the filter characteristics can be stabilized.

Moreover, when the dielectric filter is provided with the shield portion that is formed so as to cover at least part of the outer surface of the dielectric multilayer structure, the radiation of microwaves, millimeter-waves or the like from the dielectric multilayer structure transmitted through the dielectric multilayer structure or reflected without being transmitted can be limited by the shield portion. In detail, it is possible to form the shield portion in the portion where the radiation (or transmission) is desired to be prevented and form no shield portion in the portion where the radiation (or transmission) is desired to take positive effect on the outer surface of the dielectric multilayer structure.

Moreover, even when the gap exists between the waveguide and the dielectric multilayer structure, the influence that the gap exerts on the filter characteristics of the dielectric filter can be reduced by filling the gap at least partially with a conductive material, and a dielectric filter of which the quality of the filter characteristics is further stabilized can be provided.

According to the second aspect of the present invention, at least one feeding electrode is formed between any dielectric layers or inside any dielectric layers of the dielectric multilayer structure. With this arrangement, a chip type dielectric filter that can be directly mounted on a circuit formation body with the feeding electrode can be provided. Therefore, the direct mounting of the dielectric filter on the circuit formation body can be facilitated, and this allows a dielectric filter, which can be utilized for the formation of a wider variety of optical and electronic circuits, to be provided.

Moreover, in the above dielectric filter, the feeding electrode is formed directly on the dielectric layer. With this arrangement, the construction for carrying out waveguide-to-microstrip conversion, which has been necessary in the conventional dielectric filter, can be eliminated, and this allows a further compacted dielectric filter to be provided and allows the usability for the circuit formation body to be satisfactory. In particular, this arrangement is effective for mounting on a millimeter-wave band circuit or the like, which is desired to be reduced in size.

According to the third aspect of the present invention, the difference in the relative permittivity between the two or more dielectric layers is at least not smaller than ten (or preferably not smaller than twenty). With this arrangement, the Q value (Quality Factor) of the dielectric filter can be enlarged with a smaller number of layers. This allows the dielectric filter to be further compacted by reducing the number of layers of the dielectric layers while allowing the steepness of the filter characteristics of the dielectric filter to be improved.

According to the fourth aspect of the present invention, in addition to the effects of the above aspects, the dielectric layers, which are mutually adjacently layered, are joined (or closely fit) together in the dielectric multilayer structure without interposition of another material of an adhesive or the like between the dielectric layers as in the conventional dielectric filter. With this arrangement, a dielectric filter, which has stable filter characteristics without a change in the permittivity at the interface between the dielectric layers, can be provided.

According to the fifth aspect of the present invention, the dielectric layers are formed of a dielectric ceramic material of a sintering temperature of not lower than 800° C. and not higher than 1000° C. With this arrangement, the dielectric multilayer structure can be formed by layering the dielectric layers and sintering the layers by heating within the above temperature range without using the manufacturing method of bonding the dielectric layers together using an adhesive as in the conventional dielectric filter. Furthermore, by heating on the above temperature condition, the thermal expansion difference between the layers can be suppressed, and the occurrence of separation of the layers can be prevented. Therefore, a dielectric filter, which has a stable quality, can be provided.

According to the sixth aspect of the present invention, the dielectric layers are formed of a resin mixed with a dielectric ceramic material. With this arrangement, the dielectric layers can be formed by layering, for example, a plurality of greensheets of non-sintered sheets. This makes it possible to obviate the need for the labor of cutting ceramic plates out of a dielectric ceramic in a bulk form and using the plate as in the conventional case and the processing of cutting out and polishing for which high accuracy is required and to provide a dielectric filter that can be manufactured more easily.

According to the seventh aspect of the present invention, the feeding electrode is made of the material of silver, copper, gold or palladium or the alloy of the material, which have been made of a material of high specific conductance and conventionally used as the formation material of the electrodes of electronic components. With this arrangement, a chip type dielectric filter capable of facilitating the mounting on a circuit formation body can be provided.

According to the eighth aspect or the ninth aspect of the present invention, the thickness of each of the dielectric layers is inclinatorily changed. With this arrangement, the electric fields propagating inside the dielectric multilayer structure can be concentrated on the portion where the dielectric layer thickness is thin. With this arrangement, a dielectric filter, which has the filter characteristics that the reflection loss in the transmission band due to the dielectric layers is reduced, can be provided. In particular, the effects can be obtained more effectively when the thickness is inclinatorily changed so that the minimum value of the thickness becomes equal to or greater than 60% to 70% of the maximum value or desirably falls within a range of 60% to 95% or more desirably falls within a range of 70% to 90%.

According to the tenth aspect of the present invention, the thickness and the relative permittivity of each of the layers are determined and formed so that each of the dielectric layers has the product of the thickness dimension and the square root of the relative permittivity of the layer, the product having a value of an integral multiple of a quarter of the wavelength of microwaves or millimeter-waves that enter the dielectric multilayer structure, and at least one dielectric layer of the dielectric layers has the product of the thickness dimension and the square root of the relative permittivity of the layer, the product having a value of an integral multiple of a half of the wavelength. With this arrangement, a dielectric filter, which has the above effects as a bandpass filter that utilizes the principle of multiple reflection, can be used as a filter for the microwave bands or a filter for the millimeter-wave bands.

This arrangement can eliminate the problems that, when the conventional dielectric filter in which the dielectric layers are formed by being bonded together with an adhesive is used in the microwave bands and further in the millimeter-wave bands of high frequencies, the exact designed filter characteristics cannot be obtained and an adjustment mechanism is necessary due to the formation dimension errors, and the application thereof becomes very difficult as the frequency band becomes higher.

According to the eleventh aspect of the present invention, the feeding electrode is constructed of the columnar member and the rectangular member that is arranged connected to the other end of the columnar member. With this arrangement, the disorder of the distribution of electric lines of force around the rectangular member can be reduced while allowing the advantage of the columnar member that has a little transmission loss to be obtained. Therefore, the distance dimension in the direction in which the dielectric layers are layered to obtain the prescribed mode can be reduced in the dielectric filter, and this allows the dielectric filter to be compacted.

According to the twelfth aspect of the present invention, the rectangular member has end portions that include a mutually parallel tangential line at the end portion of the circumference of the columnar member. With this arrangement, the number of edge portions can be reduced at the joint portion between the end portion of the columnar member and the rectangular member, and the disorder of electric lines of force can be reduced.

According to the thirteenth aspect of the present invention, the rectangular member is the flat plate member that further has a joint portion for joining the end portions together. With this arrangement, the formation of the rectangular member and the joint between the rectangular member and the columnar member can be facilitated, and the manufacturing of the feeding electrode can be simplified.

According to the fourteenth aspect or the fifteenth aspect of the present invention, the dielectric multilayer structure is formed by layering two or more dielectric layers of mutually different relative permittivities. With this arrangement, the dielectric multilayer structure, which has the characteristic of the bandpass filter that passes only the frequencies in the prescribed wavelength band by determining the thickness of each of the dielectric layers using the principle of multiple reflection in optics, can be formed.

Further, the dielectric layers are layered so that at least one feeding electrode is placed between any dielectric layers. With this arrangement, a chip type dielectric filter, which is able to form the dielectric multilayer structure that has the feeding electrode and to be directly mounted on a circuit formation body with the feeding electrode, by layering the dielectric layers, can be manufactured.

Moreover, in the dielectric filter described above, the feeding electrode is formed directly in the dielectric layer. With this arrangement, the construction for carrying out waveguide-to-microstrip conversion, which has been necessary in the conventional dielectric filter, can be eliminated, and this allows a further compacted dielectric filter to be manufactured and allows the usability for the circuit formation body to be satisfactory. In particular, this arrangement is effective for mounting on a millimeter-wave band circuit or the like, which is desired to be reduced in size.

Furthermore, the dielectric multilayer structure is formed by sintering the dielectric layers at any temperature within a range of 800° C. to 1000° C. after the dielectric layers are layered. With this arrangement, the dielectric layers can be formed closely fit together without interposition of another material of an adhesive or the like between the dielectric layers without using the manufacturing method of bonding the dielectric layers together with an adhesive as by the conventional dielectric filter manufacturing method. With this arrangement, a dielectric filter, which has stable filter characteristics without a change in the permittivity at the interface between the dielectric layers, can be provided.

Moreover, by carrying out heating on the temperature condition, it is possible to suppress the thermal expansion difference between the layers, prevent the occurrence of separation of the layers and manufacture a dielectric filter that has a stable quality.

The above arrangement can obviate the need for the labor of cutting ceramic plates out of a dielectric ceramic in a bulk form and using the plate as in the conventional case and the processing of cutting out and polishing for which high accuracy is required and able to manufacture a dielectric filter more easily.

Moreover, the heating and sintering are carried out after the dielectric layers are crimped together by pressurization. Therefore, the dielectric layers can reliably be sintered, and the quality of the dielectric filter to be manufactured can be made satisfactory.

Moreover, the highly accurate metal processing, which has been needed for the conventional waveguide type filters and dielectric resonator filters, can be eliminated. Therefore, the dielectric filter can be manufactured at low cost in comparison with the conventional filters.

According to the sixteenth aspect of the present invention, the gap generated between the waveguide and the dielectric multilayer structure is at least partially filled with a conductive material in addition to the effects of the above aspects. With this arrangement, the influence that the gap exerts on the filter characteristics of the dielectric filter can be reduced, and a dielectric filter can be manufactured with the quality of the filter characteristics further stabilized.

BRIEF DESCRIPTION OF DRAWINGS

These and other objects and features of the present invention will become apparent from the following description taken in conjunction with preferred embodiments of the invention with reference to the accompanying drawings, in which:

FIG. 23A is a perspective view of the filter in the assembled state, and FIG. 23B is a perspective view of the filter in the disassembled state;

BEST MODE FOR CARRYING OUT THE INVENTION

Figure 1:
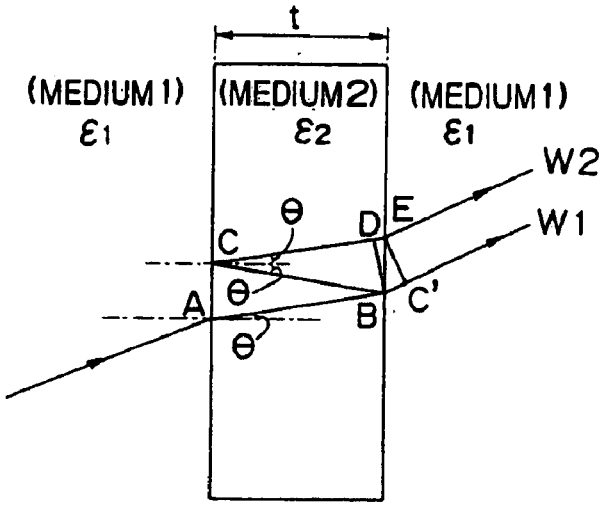
FIG. 1 is a schematic explanatory view of the principle of multiple reflection used by the present invention.

Before the description of the present invention proceeds, it is to be noted that like parts are designated by like reference numerals throughout the accompanying drawings.

Prior to describing the embodiments of the present invention, the basic principle used in the present invention is described below. The present invention uses the same principle as that used for the multiple reflection of an optical mirror of a dielectric multilayer. The principle used in the multiple reflection is described below.

As shown in FIG. 1, here is considered a case where a dielectric plate (medium 2) that has a relative permittivity $\epsilon_2$, a refractive index n and a thickness t is placed in a space of a relative permittivity $\epsilon_1$ (medium 1) and electromagnetic waves enter from the medium 1 into the medium 2. As shown in FIG. 1, when electromagnetic waves enter from the medium 1 into the medium 2 at an incident angle θ' rightward in the figure and a refracting angle in the medium 2 is assumed to be θ, an optical path difference ΔL between waves $W_1$ and $W_2$ whose optical paths are different from each other is given by Equation 1. In Equation 1, (BC+CE) represents the optical path difference between the waves W2 and W1 formed by reflection at a point B and a point C in the medium 2. Equation 1:

$$\Delta L = n(BC+CE) - \sqrt{\epsilon_1}BC'$$

In this case, an optical path length into which the refractive index n between the wave fronts BD and C'E is incorporated is equal, and therefore, Equation 2 holds. Equation 2:

$$nDE = \sqrt{\epsilon_1}BC'$$

Therefore, the optical path difference ΔL is expressed by Equation 3.

Equation 3:

$$\Delta L = n(BC + CD) = \sqrt{\varepsilon_2}\left(\frac{t\cos(2\theta)}{\cos\theta} + \frac{t}{\cos\theta}\right) = 2\sqrt{\varepsilon_2}\ t\cos\theta$$

Moreover, when the wavelength of the incident wave in a vacuum is assumed to be $\lambda_0$ according to Equation 3, a phase difference is given by Equation 4.

Equation 4:

$$\delta = \frac{2\pi\Delta L}{\lambda_0} = \frac{4\pi\sqrt{\varepsilon_2}\ t\cos\theta}{\lambda_0} = \sqrt{\varepsilon_2}\left(\frac{t\cos(2\theta)}{\cos\theta} + \frac{t}{\cos\theta}\right) = 2\sqrt{\varepsilon_2}\ t\cos\theta$$

Moreover, the transmittance of the electromagnetic wave transmitted through the medium 2 is given by Equation 5.

Equation 5:

$$T = \frac{1}{1 + C\sin^2(\delta/2)}$$

In this equation, $C=4R/(1-R)_2$, C represents a contrast and R represents reflectance.

Further, the transmittance is maximized when δ (phase difference) of Equation 4 is 2 mπ (m is an arbitrary integer), and when the velocity of light in a vacuum is assumed to be $c_0$, a frequency $f_{max}$ at which the transmittance is maximized is given by Equation 6.

Equation 6:

$$f_{\max} = \frac{mc_0}{2\sqrt{\varepsilon_2}\ t\cos\theta}$$

On the other hand, the transmittance is minimized (reflectance is maximized) when δ (phase difference) of Equation 4 is (2 m+1)π, and a frequency $f_{min}$ at which the transmittance is minimized is given by Equation 7.

Equation 7:

$$f_{\min} = \frac{(2m+1)\,c_0}{4\sqrt{\varepsilon_2}\ t\cos\theta}$$

Moreover, since θ=0 in the case of vertical incidence, Equation 6 and Equation 7 become expressed by Equation 8 and Equation 9, respectively.

Equation 8:

$$f_{\max} = \frac{mc_0}{2\sqrt{\varepsilon_2}\ t}$$

-continued

Equation 9:

$$f_{\min} = \frac{(2m+1)\,c_0}{4\sqrt{\varepsilon_2}\ t}$$

Moreover, according to Equation 8 and Equation 9, the relation of the product of the square root of relative permittivity and the thickness of the dielectric with respect to transmittance is given by Equation 10 and Equation 11, respectively.

Equation 10:

$$\sqrt{\varepsilon_2}\ t = (2m+1)\times\frac{1}{4}\lambda_0$$

Equation 11:

$$\sqrt{\varepsilon_2}\ t = m\times\frac{1}{2}\lambda_0$$

Equation 10 expresses that the transmittance is minimized, i.e., the reflectance is maximized by making the product of the square root of relative permittivity and the thickness of the dielectric an odd multiple of a quarter of the incident wavelength $\lambda_0$.

On the other hand, Equation 11 expresses that the transmittance is maximized, i.e., the reflectance is minimized by making the product of the square root of relative permittivity and the thickness of the dielectric a multiple of a half of the incident wavelength $\lambda_0$.

The above is the principle used for multiple reflection.

Figure 2:
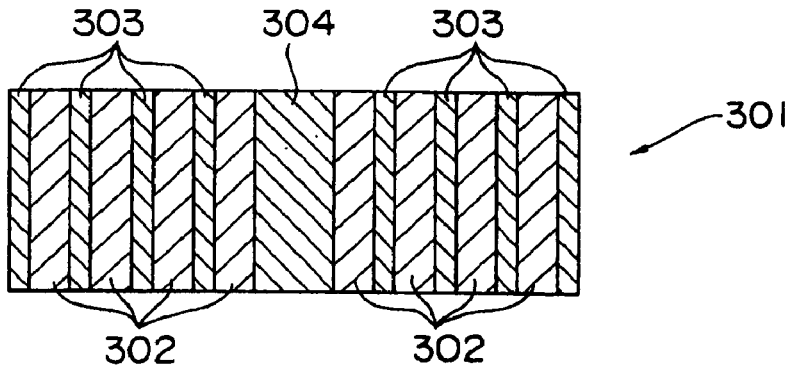
FIG. 2 is a schematic plan view of a dielectric multilayer mirror using the principle of multiple reflection of FIG. 1.
Figure 3:
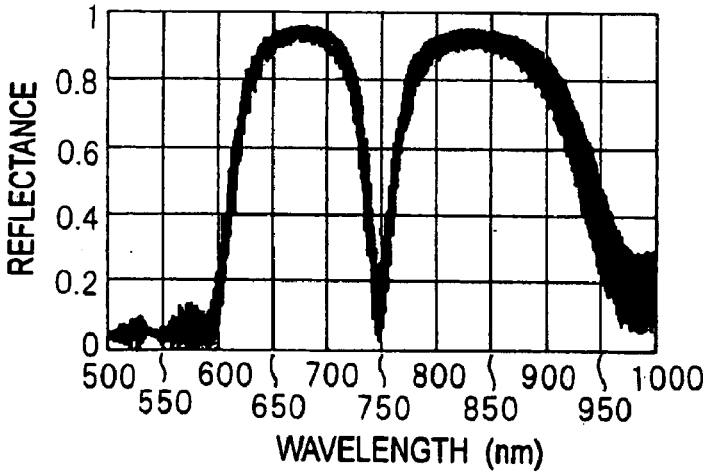
FIG. 3 is a graph showing the reflection characteristic of the dielectric multilayer mirror of FIG. 2.

Next, FIG. 2 shows a schematic plan view of the schematic construction of a dielectric multilayer mirror 301 of one example of the dielectric multilayer optical filter that utilizes the above principle, and FIG. 3 shows the reflection characteristic of the dielectric multilayer mirror 301.

As shown in FIG. 2, the dielectric multilayer mirror 301 has a structure in which a high-permittivity intermediate layer 304 formed so that the product of the square root of relative permittivity and the thickness of the dielectric is made a half of the incident wavelength is formed in a part of a dielectric multilayer structure formed by alternately layering low-permittivity films 302 and high-permittivity films 303, which are the dielectric layers of two types of mutually different relative permittivities, so that the product of the square root of relative permittivity and the thickness of the dielectric is made a quarter of the incident wavelength. The dielectric multilayer mirror 301 of the above structure becomes a bandpass filter having a characteristic that passes only frequencies in the wavelength band in the vicinity of a wavelength of 750 nm as shown in FIG. 3.

This is the principle of the filters of the microwave bands and millimeter-wave bands of one example of the dielectric filter of the present invention.

By using the present principle, the transmission/reflection characteristics of electromagnetic waves are determined by only the thickness of the dielectric. This obviates the need for carrying out post-adjustment of the filter that needs highly accurate metal processing and a very high technology in comparison with the conventional waveguide filter and dielectric resonator filter and enables the filters of microwave bands and millimeter-wave bands to be easily obtained.

Moreover, in the present specification, the "dielectric multilayer structure" is the member that is integratedly constructed of a plurality of layers formed by layering two or more dielectric layers of different relative permittivities, and the dielectric multilayer structure can also be referred to as a "dielectric laminate member". The dielectric multilayer structure, which principally has a rectangular parallelepiped configuration, may otherwise have a columnar configuration.

The embodiments of the present invention will be described in concrete below. It is a matter of course that the present invention is not limited by the following examples. Moreover, the drawings used for the explanation also include portions that are partially shown exaggerated, and the dimensions, dimensional ratios and positional relations are not always accurate.

FIRST EMBODIMENT

Figure 4:
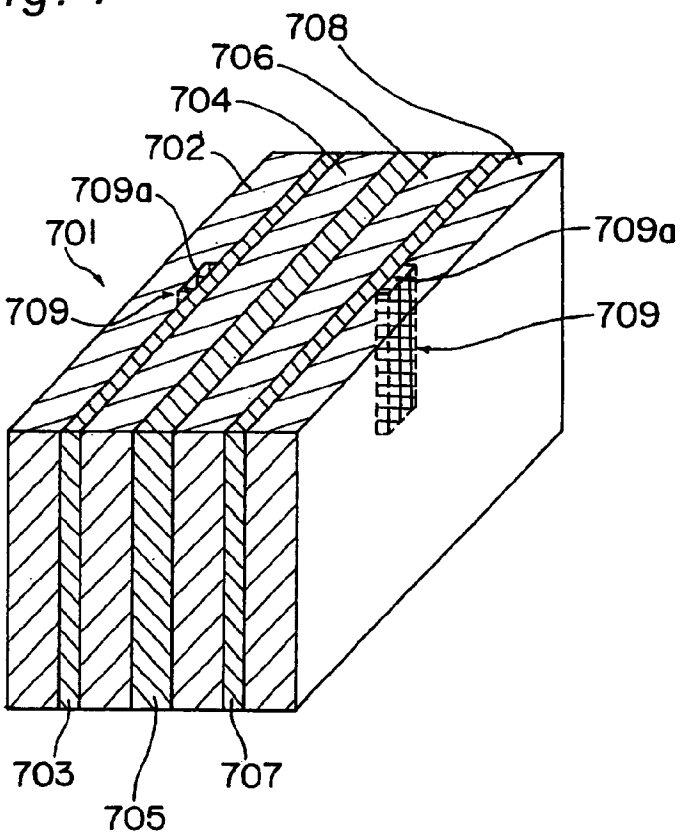
FIG. 4 is a schematic explanatory view of the internal structure of a chip type dielectric filter according to a first embodiment of the present invention.
Figure 5:
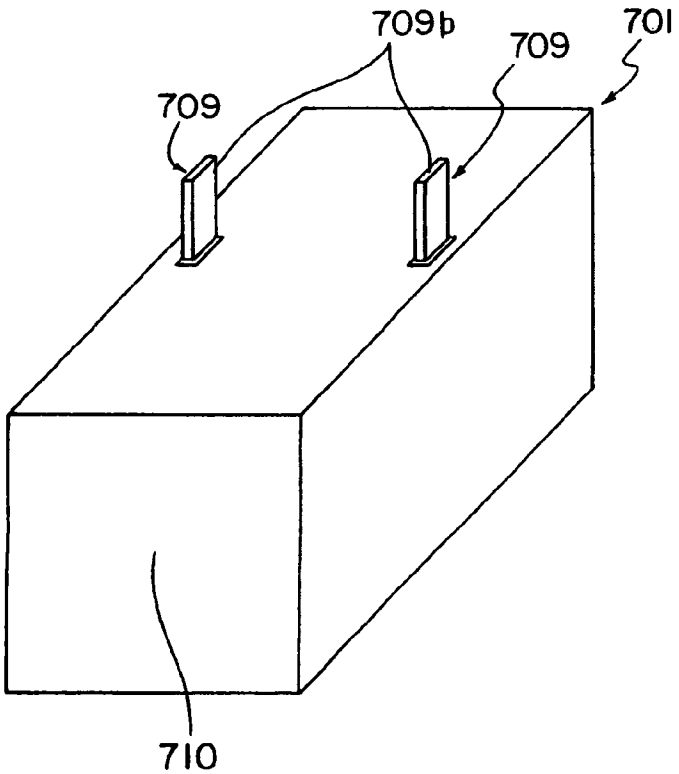
FIG. 5 is a schematic view of the external appearance of the dielectric filter of FIG. 4.

FIG. 4 shows a schematic explanatory view of the internal structure of a dielectric filter 701 as the schematic construction of the chip type dielectric filter 701 of one example of the dielectric filter (or allowed to be a dielectric filter element) according to the first embodiment of the present invention, and FIG. 5 shows a schematic explanatory view of its external appearance. As shown in FIGS. 4 and 5, the dielectric filter 701 is the chip type dielectric filter formed into a chip shape that has feeding electrodes formed between dielectric layers and allows a voltage to be applied from the outside of the dielectric filter 701.

As shown in FIG. 4, the dielectric filter 701 has a dielectric multilayer structure in which, by using a high-permittivity ceramic material and a low-permittivity ceramic material as two types of dielectric ceramic materials of mutually different relative permittivities, high-permittivity ceramic layers 703, 705 and 707 of one example of the dielectric layer formed of the high-permittivity ceramic material into a thin film shape and low-permittivity ceramic layers 702, 704, 706 and 708 of one example of the dielectric layer formed of the low-permittivity ceramic material into a thin film shape are alternately layered.

Moreover, as shown in FIG. 4, inner electrodes 709 a of metal electrodes 709 of examples of the feeding electrodes are formed between the low-permittivity ceramic layer 702 and the high-permittivity ceramic layer 703 and between the high-permittivity ceramic layer 707 and the low-permittivity ceramic layer 708.

Moreover, as shown in FIG. 5, a waveguide 710 (allowed to be a metal thin film 710) of one example of the shield portion is formed of a metal (conductor) so as to cover the entire outer surface of the dielectric multilayer structure in the dielectric filter 701, and outer electrodes 709*b* are further connected to the respective inner electrodes 709*a*, forming metal electrodes 709 projected from the outer surface of the dielectric multilayer structure.

By virtue of the dielectric filter 701 that has the above construction, a chip type dielectric filter that can be directly mounted on a circuit formation body (e.g., circuit board) allowing a voltage to be applied to the metal electrodes 709 can be provided. The detailed structure and the manufacturing method of the dielectric filter 701 that has the above features will be described below on the basis of several kinds of dielectric filters according to the examples of the present first embodiment.

EXAMPLE 1

Figure 6:
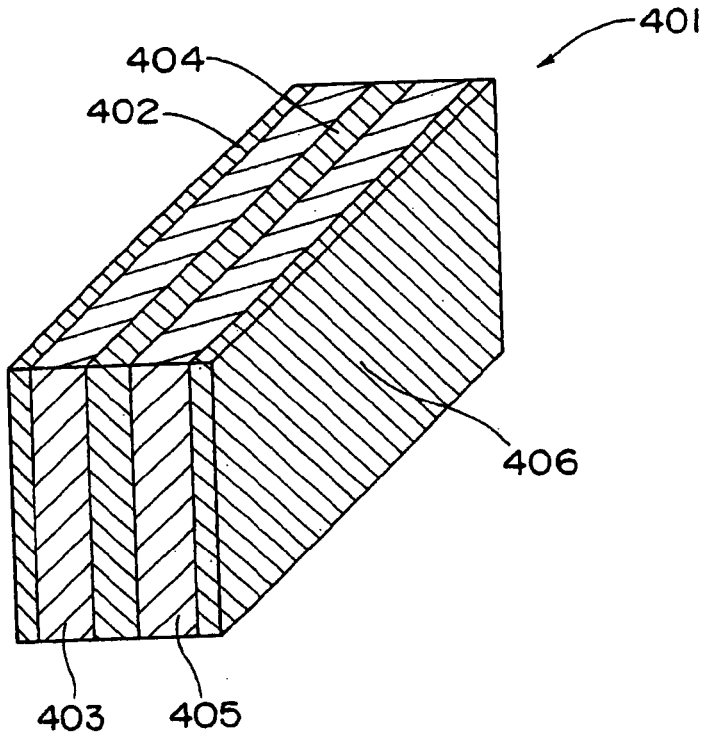
FIG. 6 is a schematic explanatory view of the dielectric filter of Example 1 for explaining the dielectric filter of the first embodiment.

The construction of the dielectric multilayer structure in the dielectric filter is first described with reference to a dielectric filter 401 of Example 1. FIG. 6 shows a schematic explanatory view showing the schematic construction of the dielectric filter 401.

As shown in FIG. 6, the dielectric filter 401 has a structure in which, by using a high-permittivity ceramic material and a low-permittivity ceramic material as two types of dielectric ceramic materials of mutually different relative permittivities, high-permittivity ceramic layers 402, 404 and 406 of one example of the dielectric layer formed of the high-permittivity ceramic material into a thin film shape and low-permittivity ceramic layers 403 and 405 of one example of the dielectric layer formed of the low-permittivity ceramic material into a thin film shape are alternately layered. Moreover, the high-permittivity ceramic layers 402, 404 and 406 and the low-permittivity ceramic layers 403 and 405 have mutually adjoining layers closely fit together in the state in which the layers are alternately layered. That is, the mutually adjoining layers are put together in the state in which the layers are closely fit together without interposition of another material of, for example, adhesive between the layers. Further, the layers are formed and layered so as to be roughly parallel to one another. It is noted that the present invention is not limited to only the case where the layers are roughly parallel to one another, and it is sometimes rather preferable that the layers are, for example, tapered (i.e., nonparallel). The above case will be described later.

In this case, the arrangement of "different relative permittivities" means that a difference in the relative permittivity between the materials is at least not smaller than ten and should preferably be not smaller than twenty. In the present first embodiment, the materials are selected so that the difference in the relative permittivity between the high-permittivity ceramic material and the low-permittivity ceramic material is not smaller than twenty. For example, in the present first embodiment, a Bi—Ca—Nb—O based dielectric ceramic material (BCN: relative permittivity=59, tan $\delta=2.33\times10^{-4}$) is used as the high-permittivity ceramic material, and an Al—Mg—Sm—O based dielectric ceramic material mixed with glass (AMSG: relative permittivity=7.4, tan $\delta=1.11\times10^{-4}$) is used as the low-permittivity ceramic material. Moreover, a dielectric ceramic material (relative permittivity=7) constituted of a crystalline layer made of $MgSiO_4$ and an Si—Ba—La—B—O based glass layer, an MgO—CaO—$TiO_2$ based material or the like can also be used besides the materials.

It is to be noted that the number of layers and the physical properties of permittivity and so on of the high-permittivity ceramic layers 402, 404 and 406 and the low-permittivity ceramic layers 403 and 405 in the dielectric multilayer structure are not limited to the values described above but allowed to take various modes. Particularly, with regard to the number of layers, the dielectric multilayer structure needs to be formed by layering two or more dielectric layers of different relative permittivities, as exemplified by the dielectric multilayer structure formed of four layers in the present first embodiment.

The manufacturing method of the dielectric filter 401 is described next. First of all, the high-permittivity ceramic layers 402, 404 and 406 in a greensheet (non-sintered sheet) state formed of BCN of the high-permittivity ceramic material and the low-permittivity ceramic layers 403 and 405 in a greensheet state formed of AMSG of the low-permittivity ceramic material are alternately layered, and the layers are crimped together with a pressure of 29.4 MPa applied at a temperature of 40° C. Subsequently, the layers are heated at any temperature within a range of 800° C. to 1000° C. or more preferably within a range of 850° C. to 950° C. with further pressurization, sintering the layers together (hot pressing process). Through this process, the high-permittivity ceramic layers 402, 404 and 406 and the low-permittivity ceramic layers 403 and 405 are sintered in the state in which the layers are closely fit together and layered, allowing the integrated dielectric multilayer structure to be formed for the manufacturing of the dielectric filter 401. It is to be noted that the greensheets are each obtained by adding and mixing the high-permittivity ceramic material or the low-permittivity ceramic material into a solution (binder) in which dibutyl phthalate and polyvinyl butyral resin are dissolved in butyl acetate served as a solvent and thereafter being formed into the sheet shape. That is, the high-permittivity ceramic layers 402, 404 and 406 are formed of the resin mixed with the high-permittivity ceramic material, and the low-permittivity ceramic layers 403 and 405 are formed of the resin mixed with the low-permittivity ceramic material. Moreover, although the forming condition is varied depending on the features, the technique of layering the greensheets and sintering the sheets by heating with pressurization is the technique used in manufacturing a multilayer ceramic board, a ceramic capacitor or the like for high-frequency use. In contrast to the fact that the accuracy of the formation thickness of each of the layers in the multilayer ceramic board or the like for high-frequency use formed by using the above technique is about several hundreds of nanometers, the accuracy of the formation thickness of each of the layers required for a dielectric filter is several hundreds of micrometers. Therefore, the above technique also sufficiently satisfies the accuracy condition for use in forming the dielectric filter. Moreover, the reason why the condition of the heating temperature range in the hot pressing process is determined as described above is to suppress the thermal expansion difference between the layers during the heating and prevent the occurrence of the separation of the layers.

Although the dielectric ceramic material is used as the dielectric in the Example 1, it is also possible to use a composite material in which fine particles of $TiO_2$, $Al_2O_3$ or the like are dispersed in a resin material of fluorocarbon resin, polycarbonate or the like.

Moreover, a method for cutting ceramic plates out of a dielectric ceramic in a bulk form and bonding the plates together is also possible. However, for the reason that high-accuracy processing of cutting, polishing or the like is necessary during the cutting of the plate-shaped ceramic materials and the reason that a dimensional error easily occurs in the bonding process and the permittivity of the interface changes when an epoxy based resin or a low melting point glass material is used as an adhesive in bonding the dielectric materials, the filter characteristics of the dielectric filter to be manufactured are sometimes adversely affected. For the above reasons, it is desirable to adopt the manufacturing method described above or the method of using the composite material in the present first embodiment.

Moreover, with regard to the formation thickness of each of the layers in the dielectric filter 401 of the Example 1, the high-permittivity ceramic layers 402 and 406 have a formation thickness of 170 μm, the low-permittivity ceramic layers 403 and 405 have a formation thickness of 510 μm, and the high-permittivity ceramic material 404 has a formation thickness of 340 μm. Moreover, a formation dimension (cross-sectional dimension) along a plane perpendicular to each formation thickness is set to 3.76 mm×1.88 mm. It is noted that the cross-sectional dimension conforms to the waveguide standard WR-15.

Moreover, the formation thickness of each of the layers is basically determined by $\lambda g/4\cdot\epsilon^{-1/2}$, and the formation thickness of the high-permittivity ceramic layer 404 as one intermediate layer of the layers is a value determined by $\lambda g/2\cdot\epsilon^{-1/2}$. Actually, the center wavelength can be finely tuned by somewhat controlling each of the values. It is noted that $\lambda g$ represents the guide wavelength in the waveguide, and the dielectric filter 401 is designed by finely tuning the formation thickness of each of the layers on the basis of the values calculated from the aforementioned equations by means of an electromagnetic simulator (High Frequency Simulation System: HFSS by Ansoft Corporation) so that the filter comes to have its center wavelength at a frequency of about 57 GHz in the Example 1.

Figure 7:
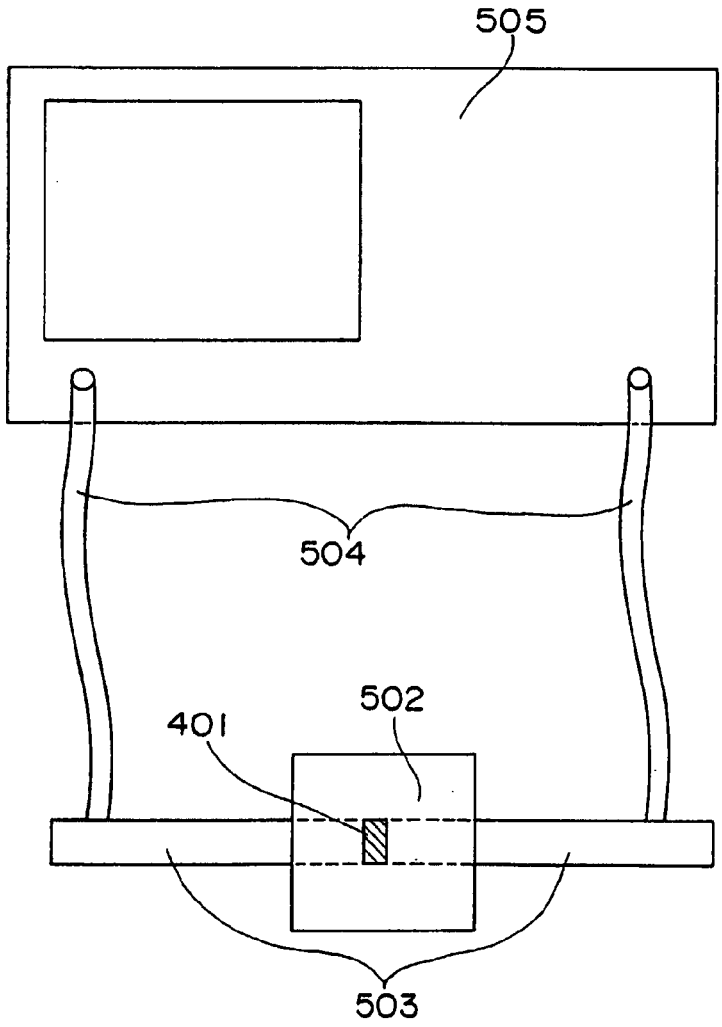
FIG. 7 is a schematic structural view of a filter characteristic measurement device of the dielectric filter of FIG. 6.

The dielectric filter 401 produced as described above was inserted into the waveguide based on the waveguide standard WR-1, and a transmission characteristic S21 and a reflection characteristic S11 of the dielectric filter 401 were measured by means of the network analyzer (37200B of Anritsu). FIG. 7 shows the schematic view of setup at the time of the measurement.

As shown in FIG. 7, the dielectric filter 401, which is the sample to be measured, is placed in the measurement waveguide 502 and connected to a network analyzer 505 via a coaxial-to-waveguide transducer 503 and a coaxial line 504.

Figure 8:
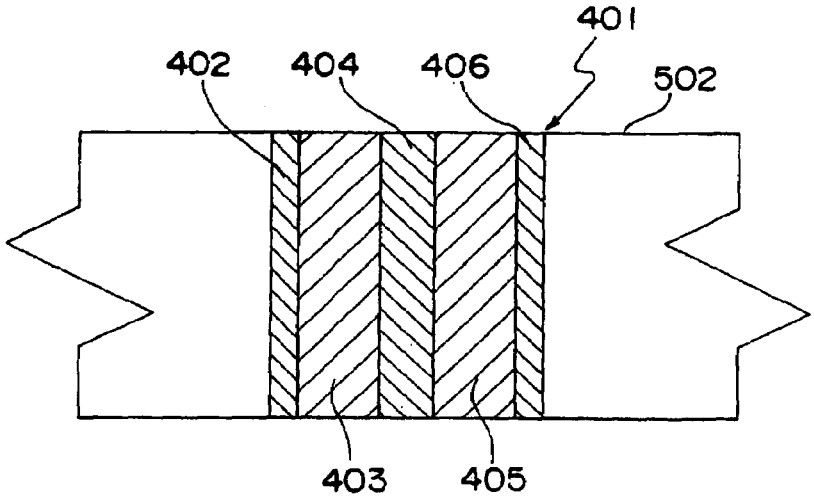
FIG. 8 is a partially enlarged schematic plan view of the measurement waveguide of the filter characteristic measurement device of FIG. 7.
Figure 9:
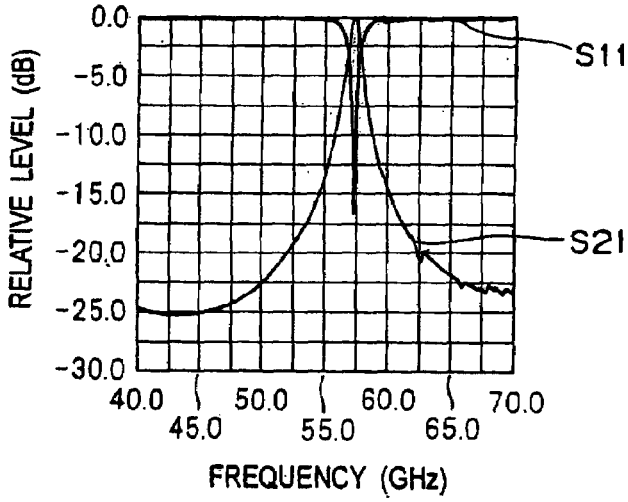
FIG. 9 is a plot chart showing the filter characteristics of the dielectric filter of FIG. 6.

FIG. 8 shows a partially enlarged schematic plan view of the measurement waveguide 502 in the neighborhood of the portion where the dielectric filter 401 is placed, and FIG. 9 shows the measurement results of the dielectric filter 401 by means of the network analyzer 505.

As shown in FIG. 8, the dielectric filter 401 is placed in the measurement waveguide 502 that has a roughly prismatic cylinder configuration so that the inner peripheral surface of the measurement waveguide 502 and the outer peripheral surface of the dielectric filter 401 are closely fit to each other without any gap. The dielectric filter 401 is also placed so that the thickness direction of the layers of the dielectric filter 401 coincides with the lengthwise direction of the measurement waveguide 502.

Moreover, in FIG. 9 showing the measurement results of the dielectric filter 401 by means of the network analyzer 505, the horizontal axis represents frequency (GHz), and the vertical axis represents attenuation (dB). FIG. 9 also shows the reflection characteristic S11 and the transmission characteristic S21 at each frequency as the filter characteristics of the dielectric filter 401. According to FIG. 9, it can be understood that the transmission frequency is about 57.5 GHz since the lower end point of the reflection characteristic S11 and the upper end point of the transmission characteristic S21 are located at a frequency of about 57.5 GHz. Moreover, the value was approximately the same value as that of the result calculated by the electromagnetic simulator. Moreover, there was obtained a filter characteristic such that the transmission characteristic S21 of the dielectric filter 401 had a loss of about 0.2 dB at the transmission frequency and the attenuation at the cutoff frequency, i.e., isolation was about 25 dB.

EXAMPLE 2

Figure 10:
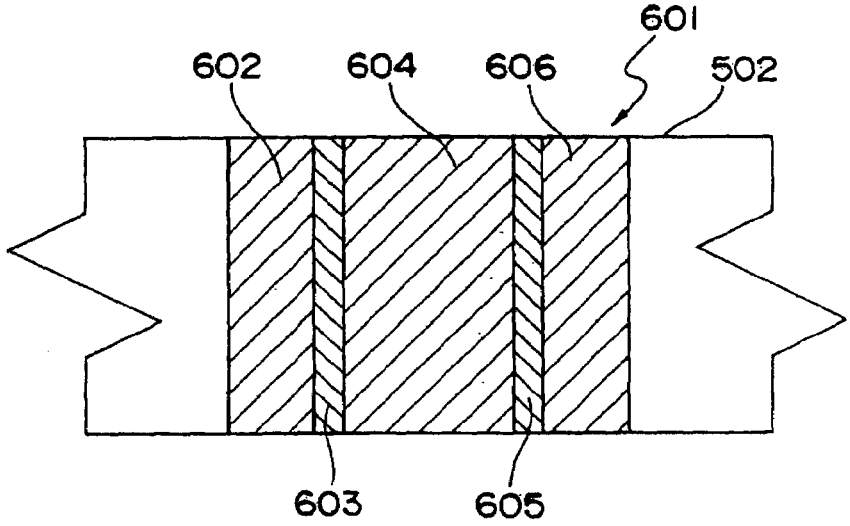
FIG. 10 is a schematic explanatory view of a dielectric filter (in which the high-permittivity layer and the low-permittivity layer are replaced with each other in arrangement) according to Example 2 of the first embodiment in a state in which the filter is placed in the measurement waveguide.

Next, as a modification example of the dielectric filter 401 of the Example 1, a dielectric filter in which the low-permittivity ceramic layer and the high-permittivity ceramic layer are formed replaced with each other according to Example 2 is described. FIG. 10 shows a schematic explanatory view of a dielectric filter 601 of one example of the dielectric filter according to the modification example in a state in which the filter is placed in the measurement waveguide 502 of the filter characteristic measurement device.

As shown in FIG. 10, the dielectric filter 601 is formed by interchanging the order of layering the high-permittivity ceramic layers 402, 404 and 406 and the low-permittivity ceramic layers 403 and 405 in the dielectric filter 401. Concretely, in the dielectric filter 601, a dielectric multilayer structure is formed by layering high-permittivity ceramic layers 603 and 605 on both sides of a low-permittivity ceramic layer 604 employed as an intermediate layer and further layering low-permittivity ceramic layers 602 and 606 on the respective layers. It is noted that the manufacturing method of the dielectric filter 601 is the same as the manufacturing method of the dielectric filter 401 of the Example 1.

Figure 11:
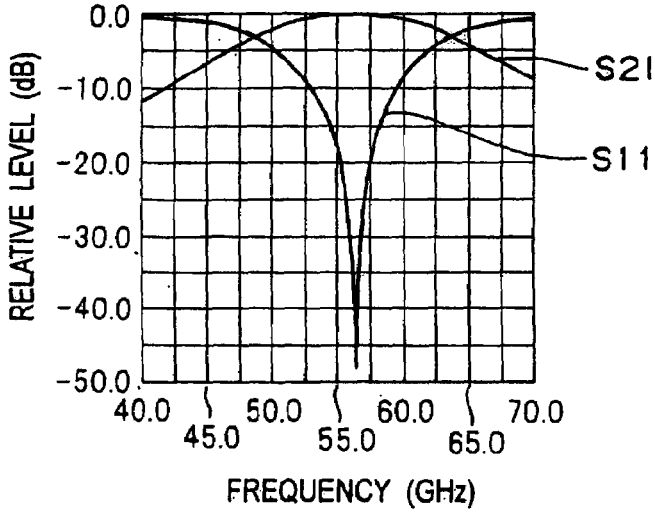
FIG. 11 is a plot chart showing the filter characteristics of the dielectric filter of FIG. 10.

FIG. 11 shows the reflection characteristic S11 and the transmission characteristic S21 as the filter characteristics of the dielectric filter 601 of the Example 2 of the above construction. It is noted that the filter characteristics of FIG. 11 have an axis system similar to that of FIG. 9 mentioned hereinabove. As shown in FIG. 11, it can be understood that the characteristic curves of the reflection characteristic S11 and the transmission characteristic S21 exhibit a broad configuration in comparison with the characteristic curves of the dielectric filter 401 of the Example 1 shown in FIG. 9. The above fact indicates that steeper filter characteristics are obtained when the high-permittivity layer is employed as the intermediate layer and is desirable as a bandpass filter in the case where the dielectric multilayer structure is formed by combining the high-permittivity layer and the low-permittivity layer.

Furthermore, it is desirable to increase the cyclicity (about eight cycles) of the dielectric ceramic materials to be selected in order to obtain a steeper transmission characteristic. In the above case, it is necessary to form the dielectric multilayer structure paying attention to the thermal contraction coefficient of the single layer of the dielectric ceramic materials and its contraction factor after sintering. The above is intended to prevent in advance defective sintering owing to the occurrence of separation due to heating in the hot pressing process.

EXAMPLE 3

Figure 12:
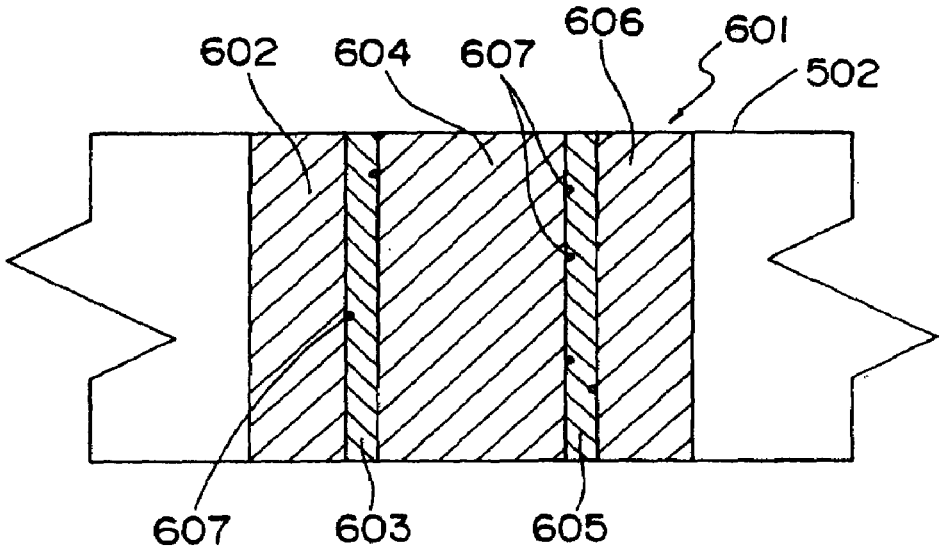
FIG. 12 is a schematic explanatory view of a dielectric filter (in which bubbles exist) according to Example 3 of the first embodiment in a state in which the filter is placed in the measurement waveguide.
Figure 13:
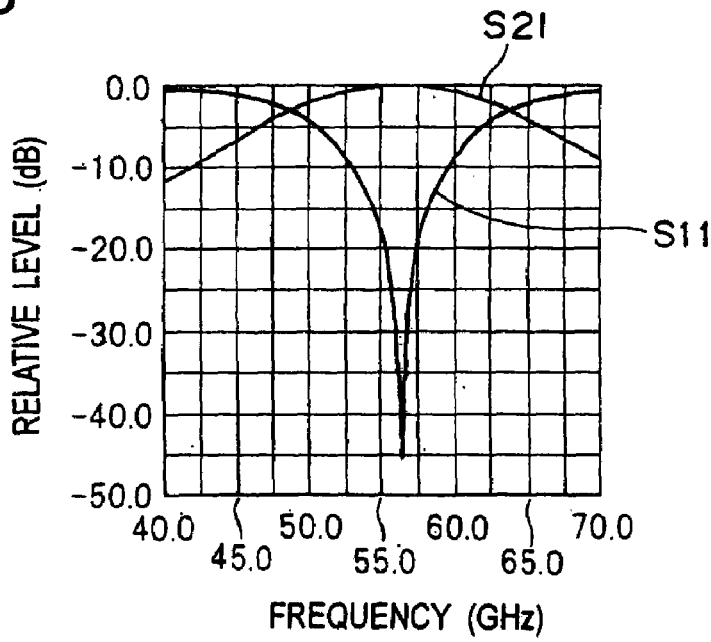
FIG. 13 is a plot chart showing the filter characteristics of the dielectric filter of FIG. 12.

Next, in the schematic explanatory view of the dielectric filter 601 of FIG. 12 of Example 3, the dielectric filter 601 of Example 2 shown in FIG. 10 has a small amount of bubbles (pores) 607 existing in the interface of the dielectric layers, and FIG. 13 shows the transmission characteristic S21 and the reflection characteristic S11 as the filter characteristics in the case. It can be understood that neither the transmission characteristic S21 nor the reflection characteristic S11 change when the characteristic curves of FIG. 13 is compared with the characteristic curve of FIG. 11. Therefore, it can be understood that, so long as the bubbles 607 existing in the interface between the dielectric layers are on the order of several bubbles, the existence of the bubbles 607 does not influence the filter characteristics.

EXAMPLE 4

Figure 14:
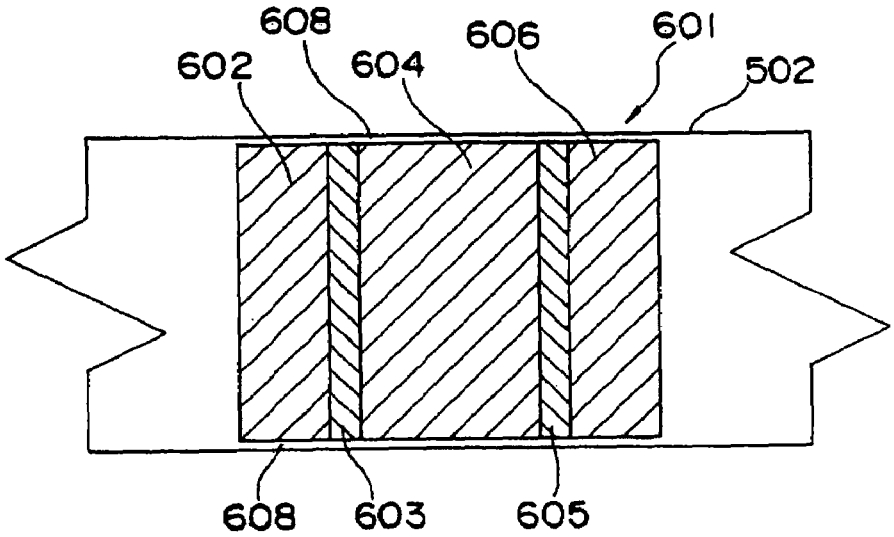
FIG. 14 is a schematic explanatory view of a dielectric filter (in which a gap exists between the waveguide and the dielectric multilayer structure) according to Example 4 of the first embodiment in a state in which the filter is placed in the measurement waveguide.
Figure 15:
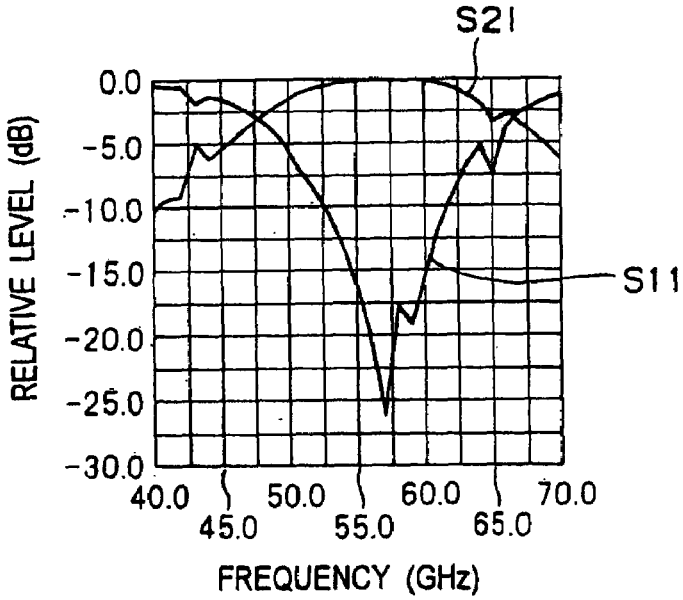
FIG. 15 is a plot chart showing the filter characteristics of the dielectric filter of FIG. 14.

Furthermore, in the schematic explanatory view of the dielectric filter 601 of FIG. 14 of Example 4, the dielectric filter 601 of the Example 2 shown in FIG. 10 has a minute gap (interspace) 608 existing between the outer surfaces of the dielectric layers and the inner surface of the measurement waveguide 502, and FIG. 15 shows the transmission characteristic S21 and the reflection characteristic S11 as the filter characteristics in the case. When the characteristic curves of FIG. 15 is compared with the characteristic curves of FIG. 10, it can be understood that the transmission characteristic S21 and the reflection characteristic S11 are largely changed, and the existence of the gap 608 largely influences the filter characteristics. This therefore indicates the necessity of processing for burying the gap by filling the gap with a conductive paste of one example of the conductive material by means of, for example, a dispenser or similar processing so that the gap between the outer surface of the dielectric multilayer structure and the inner surface of the waveguide disappears when inserting the dielectric filter 601 into the waveguide. It is also considered to be particularly difficult to practically completely bury the gap, it may be a case where the gap is partially filled with a conductive paste or the like so that the gap becomes smaller.

(Structure and Manufacturing Method of Chip Type Dielectric Filter 701)

The detailed structure and the manufacturing method of the chip type dielectric filter 701 of the present first embodiment provided with the dielectric multilayer structure explained on the basis of the above embodiments are described next with reference to FIGS. 4 and 5. The construction and so on of the dielectric multilayer structure provided for the dielectric filter 701 should be understood referring to the Example 1 through the Example 4 that have already been described.

In the dielectric filter 701 as shown in FIG. 4, the high-permittivity ceramic layers 703, 705 and 707 and the low-permittivity ceramic layers 702, 704, 706 and 708 have mutually adjoining layers closely fit together in the state in which the layers are alternately layered. That is, the layers are closely fit together without interposition of another material of, for example, an adhesive. Further, the layers are formed and layered so as to be roughly parallel to one another. Moreover, as shown in FIG. 4, the inner electrodes 709*a* formed between the low-permittivity ceramic layer 702 and the high-permittivity ceramic layer 703 and between the high-permittivity ceramic layer 707 and the low-permittivity ceramic layer 708 have one end exposed from the end surfaces of the respective layers on the upper side in the figure. Outer electrodes are connected and formed on the exposed portions as described later, forming the metal electrodes 709. It is noted that the metal electrodes 709 are intended to externally apply a voltage to the dielectric layers where the metal electrodes 709 are provided. Therefore, the metal electrodes 709 need to be finally exposed to the outside of the dielectric filter 701 and formed so as to allow the voltage to be applied.

Moreover, a Bi—Ca—Nb—O based dielectric ceramic material (BCN: relative permittivity=59, tan $\delta=2.33\times10^{-4}$) is used as the high-permittivity ceramic material, and an Al—Mg—Sm—O based dielectric ceramic material mixed with glass (AMSG: relative permittivity=7.4, tan $\delta=1.11\times10^{-4}$) is used as the low-permittivity ceramic material. Moreover, a dielectric ceramic material (relative permittivity=7) constituted of a crystalline layer made of $MgSiO_4$ and an Si—Ba—La—B—O based glass layer, an MgO—CaO—$TiO_2$ based material or the like can also be used besides the materials.

The number of layers and the physical properties of permittivity and so on of the high-permittivity ceramic layers 703, 705 and 707 and the low-permittivity ceramic layers 702, 704, 706 and 708 in the dielectric multilayer structure are not limited to the values described above but allowed to take various modes. Particularly, with regard to the number of layers, the dielectric multilayer structure needs to be formed by layering two or more dielectric layers of different relative permittivities, as exemplified by the dielectric multilayer structure formed of seven layers in the present first embodiment.

The manufacturing method of the dielectric filter 701 is described next. First of all, the high-permittivity ceramic layers 703, 705 and 707 in a greensheet (non-sintered sheet) state formed of BCN of the high-permittivity ceramic material and the low-permittivity ceramic layers 702, 704, 706 and 708 in a greensheet state formed of AMSG of the low-permittivity ceramic material are alternately layered, and the layers are crimped together with a pressure of 29.4 MPa applied at a temperature of 40° C. Subsequently, the layers are heated at any temperature within a range of 800° C. to 1000° C. or more preferably within a range of 850° C. to 950° C. with further pressurization, sintering the layers together (hot pressing process). Through this process, the high-permittivity ceramic layers 703, 705 and 707 and the low-permittivity ceramic layers 702, 704, 706 and 708 are sintered in the state in which the layers are closely fit together and layered, allowing the integrated dielectric multilayer structure to be formed for the manufacturing of the dielectric filter 701.

Moreover, as shown in FIG. 4, in the case where the inner electrodes 709 a are formed between the aforementioned layers of the dielectric filter 701, the hot pressing process is carried out in a humidified nitrogen atmosphere when copper is used as the formation material of the inner electrodes 709*a* or by burning the binder by processing in the atmosphere at a temperature of 600° C. for two hours and thereafter changing the atmosphere to a nitrogen atmosphere when silver or palladium is used as the formation material.

It is to be noted that the greensheets are each obtained by adding and mixing the high-permittivity ceramic material or the low-permittivity ceramic material into a solution (binder) in which dibutyl phthalate and polyvinyl butyral resin are dissolved in butyl acetate served as a solvent and thereafter being formed into the sheet shape. Moreover, in the greensheet, the pattern of the inner electrodes 709*a* in a rectangular shape can be formed by making metal powder of silver, copper or palladium and a conductive paste dissolved in an organic solvent adhere to the surface of the greensheet in a process for printing and drying the materials by means of screen plate making. The formation method is used for manufacturing a multilayer ceramic board, a ceramic capacitor and so on for high-frequency use.

Although the dielectric ceramic material is used as a dielectric in the present first embodiment, it is, of course, possible to use a composite material obtained by dispersing fine particles of $TiO_2$, $Al_2O_3$ or the like in a resin material of fluorocarbon resin, polycarbonate or the like.

Moreover, a method for cutting ceramic plates out of a dielectric ceramic in a bulk form and bonding the plates together is also possible. However, for the reason that high-accuracy processing of cutting, polishing or the like is necessary during the cutting of the plate-shaped ceramic materials and the reason that a dimensional error easily occurs in the bonding process and the permittivity of the interface changes when an epoxy based resin or a low melting point glass material is used as an adhesive in bonding the dielectric materials, the filter characteristics of the dielectric filter to be manufactured are sometimes adversely affected. For the above reasons, it is desirable to adopt the manufacturing method described above or the method of using the composite material in the present second embodiment.

Moreover, by using a dielectric ceramic material used for an LTCC (Low Temperature Co-fired Ceramic) board including AMSG, BCN, ZTG (Zn—Ti-glass) and BNT (Ba—Nb—Ti-glass) (The principal ingredients of the glass are PbO, $B_2O_3$ and $SiO_2$) as the formation material of the dielectric layers, the sintering temperature can be lowered. Therefore, metals of silver and copper systems that have a high specific conductance can be used as the formation material of the inner electrodes 709*a*, and this is desirable.

Moreover, in the dielectric filter 401 of the first embodiment, with regard to the formation thickness of each of the layers, the high-permittivity ceramic layers 703 and 707 have a formation thickness of 170 μm, the low-permittivity ceramic layers 704 and 706 have a formation thickness of 510 μm, and the high-permittivity ceramic material 705 has a formation thickness of 340 μm. Moreover, a formation dimension (cross-sectional dimension) along a plane perpendicular to each formation thickness is set to 3.76 mm×1.88 mm.

Moreover, in the dielectric filter 701, each of the inner electrodes 709*a* is formed buried in the low-permittivity ceramic layer 702 so that one end surface is positioned in the boundary surface between the high-permittivity ceramic layer 703 and the low-permittivity ceramic layer 702 or formed buried in the low-permittivity ceramic layer 708 so that one end surface is positioned in the boundary surface between the high-permittivity ceramic layer 707 and the low-permittivity ceramic layer 708. Therefore, the formation thickness of each of the low-permittivity ceramic layers 702 and 708 becomes a distance between the one end surface of each of the inner electrodes 709*a* and the terminal end surface of the dielectric filter 701. Therefore, the formation thickness of each of the layers needs to be determined so that the impedance of each of the inner electrodes 709*a* becomes about 50 ohms. In general, the distance is often determined as a distance of about $\lambda g/4\sqrt{\epsilon}$, and the formation thickness of each of the low-permittivity ceramic layers 702 and 708 is formed to be about 500 μm in the present second embodiment.

After the dielectric multilayer structure is formed by the formation method as described above, a waveguide 710 (or a metal thin film 710) formed of a metal is formed so as to cover the entire outer surface of the dielectric multilayer structure excluding the exposed portions of the inner electrodes 709*a* as shown in FIG. 5. In addition, the outer electrodes 709*b* formed of a similar metal material are connected to the respective exposed portions of the inner electrodes 709*a*, forming the metal electrodes 709 in a state in which the electrodes project from the outer surface of the dielectric multilayer structure. It is desirable to form the waveguide 710 by applying a metal paste obtained by mixing metal powder with an organic solvent or depositing the paste by the electron-beam evaporation method, the sputtered method or the like on the outer surface of the dielectric multilayer structure. The formation of the waveguide 710 on the outer surface of the dielectric multilayer structure is intended to prevent, for example, microwaves and millimeter-waves, which are transmitted through the dielectric multilayer structure or reflected on the dielectric multilayer structure without being transmitted, from being radiated from the dielectric multilayer structure. Moreover, the metal electrodes 709 and the waveguide 710 formed on the outer surface of the dielectric multilayer structure are electrically insulated from each other, and therefore, the metal electrodes 709 are not electrically continued to each other via the waveguide 710. It is possible to set the thickness of the waveguide 710 (metal thin film 710 or metal) formed as described above to several hundreds of angstroms so long as the continuity can be assured. However, practically taking the functions of, for example, a skin effect and durability other than the continuity into consideration, the thickness should desirably be set not smaller than tens of micrometers.

Although the case where two metal electrodes 709 are formed on the dielectric filter 701 has been described above, the present invention is not limited to the case, and it is only required to form at least one metal electrode 709. Moreover, the inner electrodes 709*a* are not limited only to the case where the layers are formed between the respective layers but allowed to be formed inside any of the layers instead of the above case. This is because the function of the electrode can be produced so long as the inner electrode 709*a* is formed in relation to any of the layers.

Moreover, instead of the case where the waveguide 710 is formed so as to cover the entire outer surface of the dielectric multilayer structure, it may be a case where the waveguide 710, or the metal thin film 710 covers part of the outer surface. This is because a case where the outer surface, which is not covered, is covered with a structure other than the dielectric filter 701 can also be considered. Moreover, a way of use such that the outer surface is partially shielded and partially not shielded, and microwaves or millimeter-waves are positively radiated from the portion that is not shielded can also be considered. For example, it is a case where the metal thin film 710 is not formed on the side surfaces that are mutually opposing in the transverse direction in FIG. 5.

Figure 16:
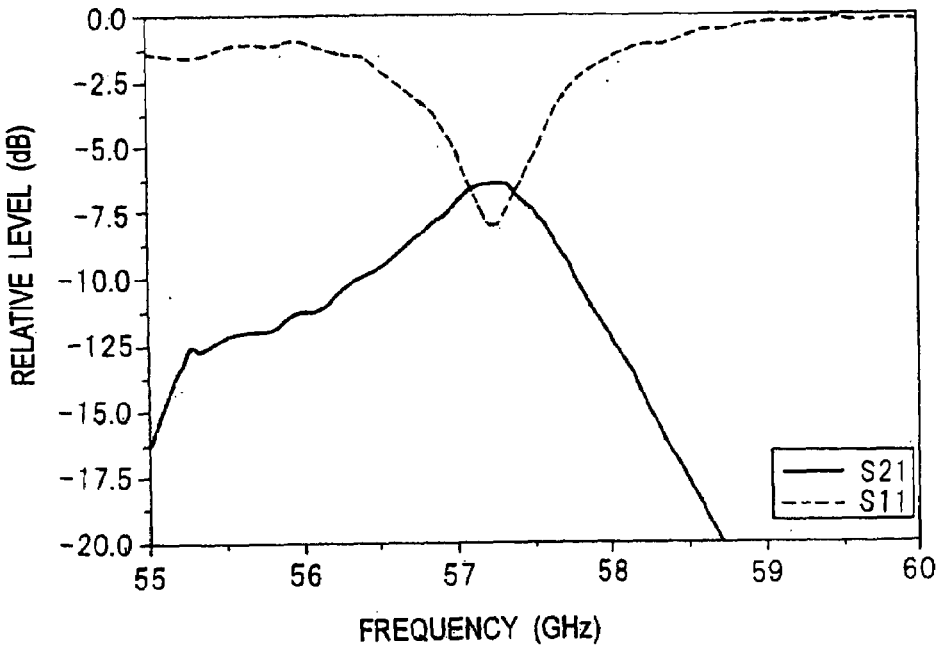
FIG. 16 is a plot chart showing the filter characteristics of the chip type dielectric filter of the first embodiment of FIGS. 4 and 5.

The chip type dielectric filter 701 is completed by the manufacturing method as described above. The transmission characteristic S21 and the reflection characteristic S11 of the filter in the thus produced chip type dielectric filter 701 were measured by the network analyzer (37200B of Anritsu) used in the first embodiment. FIG. 16 shows the measurement results. In FIG. 16, the horizontal axis represents frequency (GHz), and the vertical axis represents attenuation (dB). As shown in FIG. 16, it can be understood that the transmission frequency is about 57.5 GHz since the lower end point of the reflection characteristic S11 and the upper end point of the transmission characteristic S21 are located at a frequency of about 57.5 GHz. Moreover, there was a loss of about −7.5 dB at the transmission frequency, and a reflection characteristic of −25 dB (note that this numerical value was not shown) was obtained in terms of attenuation at the cutoff frequency, i.e., isolation.

It is desirable to increase the cyclicity (about eight cycles) of the dielectric ceramic materials to be selected in order to obtain a steeper transmission characteristic. In the above case, it is necessary to form the dielectric multilayer structure paying attention to the thermal contraction coefficient of the single layer of the dielectric ceramic materials and its contraction factor after sintering. The above is intended to prevent in advance defective sintering owing to the occurrence of separation due to heating in the hot pressing process.

Although the dielectric multilayer structure is formed by layering the layers so that the surfaces of the dielectric layers become roughly parallel to one another, the present invention is not limited to this. It is sometimes more preferable that the dielectric layers have a tapered (nonparallel) configuration as described later.

Furthermore, it is needless to say that the shape shown in FIGS. 4 and 5 is one example with regard to the shape of the metal electrodes 709, and various shapes can be taken besides them.

According to the first embodiment of the present invention, the following various effects can be obtained.

First of all, by forming the dielectric filter using the principle of multiple reflection in optics (e.g., principle of multiple reflection of electromagnetic waves) as described above, the transmission/reflection characteristics (filter characteristics) of electromagnetic waves are to be determined only by the formation thickness of each of the dielectric layers. Therefore, by using, for example, a technique for accurately determining the formation thickness of a layer used for the manufacturing of ceramic capacitors for the formation thickness of the dielectric layers, the dielectric multilayer structure of the dielectric filter of a comparatively high accuracy can be formed.

In concrete, for example, when the dielectric multilayer structure in the dielectric filter 401 is formed as in the Example 1, the dielectric multilayer structure is formed by crimping together the dielectric layers in the greensheet shape formed of the dielectric ceramic material and thereafter sintering the layers by heating on the prescribed temperature condition with further pressurization in the present first embodiment instead of forming the layers by cutting (machining) a dielectric ceramic plates from a dielectric ceramic in a bulk form and bonding the ceramic plates together with the surfaces polished as by the conventional manufacturing method. This therefore can obviate the need for the processing of machining, polishing or the like with high accuracy. Therefore, the structure can be manufactured easily in comparison with the conventional dielectric multilayer structure manufacturing method.

Moreover, the dielectric layers are layered by sintering while being crimped together as described above instead of bonding dielectric layers via an adhesive or the like as by the conventional manufacturing method. Therefore, the dielectric filter 401 can reliably be manufactured neither with interposition of another material between the dielectric layers nor a change in the permittivity at the interface between the layers. Therefore, the quality of the filter characteristics of the dielectric filter 401 to be manufactured can be stabilized, so that the dielectric filter of higher reliability can be manufactured. Moreover, since the quality of the filter characteristics can be stabilized, an adjustment work that requires a very high technology can be eliminated in mounting to the waveguide.

Moreover, by using the dielectric ceramic materials that have a sintering temperature range of 800° C. to 1000° C. for the formation of the dielectric multilayer structure in the dielectric filter 401 and carrying out the sintering by heating on the temperature condition, it is possible to suppress the thermal expansion difference between the layers, prevent the occurrence of separation of the layers and stabilize the quality of the dielectric filter 401 to be manufactured.

Moreover, by virtue of the layered structure of the high-permittivity ceramic layers 402, 404 and 406 and the low-permittivity ceramic layers 403 and 405 formed as the two kinds of dielectric layers of mutually different permittivities in the dielectric filter 401 like, for example, the first example, the formation thickness of each layer determined basically by $\lambda g/4\cdot\epsilon^{-1/2}$ and the formation thickness of the high-permittivity ceramic layer 404 of the intermediate layer determined by $\lambda g/2\cdot\epsilon^{-1/2}$, the dielectric filter 401 can be provided with the characteristics of the bandpass filter that passes only the frequencies in the prescribed wavelength band. Moreover, the dielectric filter 401 can be used as a filter for microwaves or a filter for millimeter-waves.

Moreover, when the dielectric multilayer structure is formed by layering the high-permittivity ceramic layers with the low-permittivity ceramic layers in combination, a steeper filter characteristic curve can be obtained when the high-permittivity ceramic layer is used as the intermediate layer and a satisfactory dielectric filter can be provided as a bandpass filter than when the low-permittivity ceramic layer is used as the intermediate layer.

Moreover, by setting the difference in the relative permittivity between the formation materials of the dielectric layers at least not smaller than ten and preferably not smaller than twenty, the Q value (Quality Factor) of the dielectric filter 401 can be enlarged. For example, when a dielectric filter of a cyclicity of three is formed by a combination of AMSG and a $ZrO_2$—$TiO_2$ based glass (ZTG: $\epsilon_r$=17), of which the relative permittivity difference is not greater than 10, the loaded Q value is 23.1 (non-loaded Q value is 2024). However, when a dielectric filter of a cyclicity of three is formed by a combination of AMSG and BCN, of which the relative permittivity difference is not smaller than 20, the loaded Q value is 51 (non-loaded Q value is 5000), so that about double loaded Q value can be obtained. As is apparent from the above, in the first embodiment, the material are selected so that the difference in the relative permittivity between the high-permittivity ceramic material and the low-permittivity ceramic material becomes equal to or greater than 20, the Q value of the dielectric filter 401 can be enlarged with a smaller number of layers. With this arrangement, the dielectric filter 401 can be further reduced in size by reducing the number of layers of the high-permittivity ceramic material and the low-permittivity ceramic material while allowing the steepness of the filter characteristics of the dielectric filter 401 to be improved.

Furthermore, by forming the metal electrodes 709 between (or inside) any ones of the dielectric layers in the dielectric multilayer structure and shielding by covering the entire outer surface waveguide (metal thin film) 710, the chip type dielectric filter 701 can be formed. By thus forming the chip type dielectric filter 701, the compact configuration of the dielectric multilayer structure can be achieved. In addition, the waveguide-to-microstrip conversion can be eliminated by virtue of the built-in metal electrodes 709 and the shielded outer surface of the waveguide (metal thin film) 710, and a further size reduction becomes possible. Therefore, a filter for use in the microwave band or the millimeter-wave band capable of directly mounting the chip type dielectric filter 701 on a subminiature circuit formation body (e.g., circuit board) without necessitating the processing of the dielectrics and the casing for which very high processing accuracy is required.

SECOND EMBODIMENT

Figure 17:
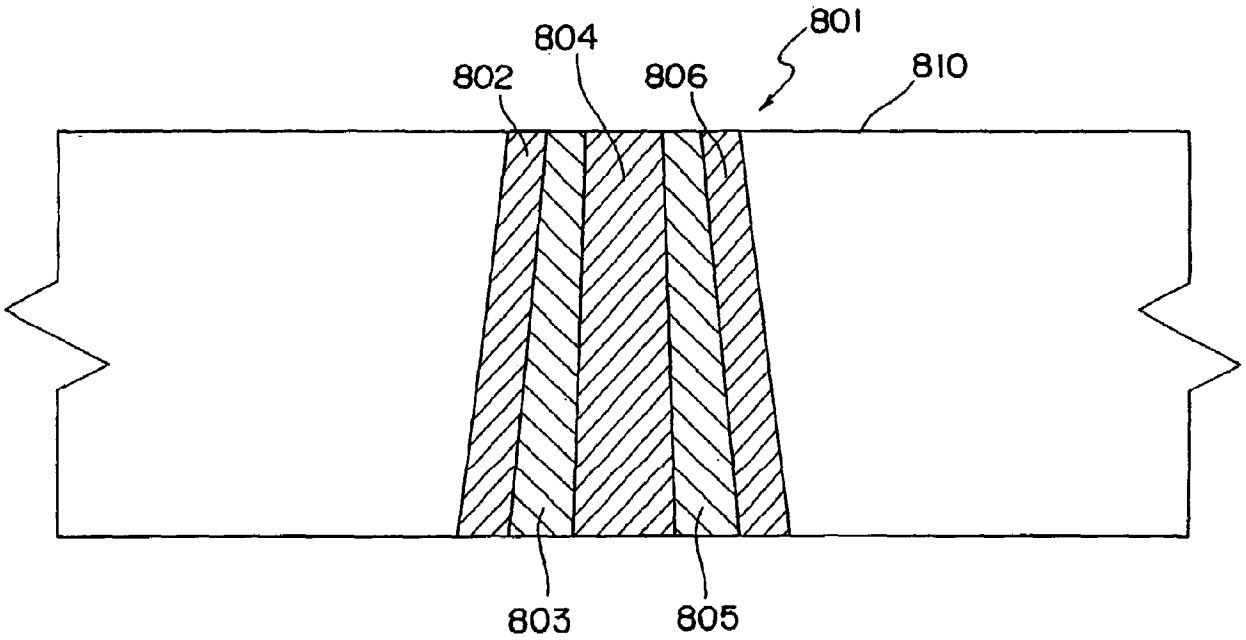
FIG. 17 is a schematic explanatory view of the construction of a dielectric filter (in which the dielectric layers are inclined) according to a second embodiment of the present invention.

A waveguide type dielectric filter 801 of one example of the dielectric filter manufactured by the dielectric filter and the dielectric filter manufacturing method according to the second embodiment of the present invention is described next. The dielectric filter 801 is an example of the filter device of which the return loss is increased by continuously changing the formation thickness of each dielectric layer. In the present second embodiment, the formation thickness of each dielectric layer is continuously changed. FIG. 17 shows a schematic explanatory view schematically showing the structure of the dielectric filter 801 of the structure.

As shown in FIG. 17, the dielectric filter 801 is placed in a waveguide 810 that conforms to the waveguide standard WR-15 and provided with a dielectric multilayer structure in which high-permittivity ceramic layers (formed by using BCN as a high-permittivity ceramic material) 802, 804 and 806 and low-permittivity ceramic layers (formed by using AMSG as a low-permittivity ceramic material) 803 and 805 are alternately layered inside the waveguide 810, in which the layers are continuously changed in thickness, i.e., inclinatorily changed. In concrete, each of the high-permittivity ceramic layers 802 and 806 has a formation thickness of 0.17 mm in the thickest portion and a formation thickness of 0.13 mm in the thinnest portion. Moreover, each of the low-permittivity ceramic layers 803 and 805 has a formation thickness of 0.51 mm in the thickest portion and a formation thickness of 0.45 mm in the thinnest portion. Further, a high-permittivity ceramic layer 804 that also serves as the intermediate layer has a formation thickness of 0.34 mm in the thickest portion and a formation thickness of 0.25 mm in the thinnest portion. The inclinatory change in the formation thickness as described above should preferably change so that the minimum value of the formation thickness becomes 60% to 70% or more of the maximum value. More concretely, the effect of inclination can be obtained within a range of 60% to 95% and should desirably be within a range of 70% to 90%. A change largely deviating from the fundamental formation thickness leads to not only impaired characteristics of the filter but also impossible obtainment of the desired filter characteristics. Therefore, it is desirable to determine the change range condition of the formation thickness as described above. Moreover, as shown in FIG. 17, the formation thickness of each dielectric layer is reduced upwardly in the figure and increased downwardly in the figure. The cross-sectional shape of each dielectric layer is a wedge shape, and the electromagnetic waves that enter the dielectric filter 801 travel in complicated paths and pass through the dielectric layers in comparison with the case where the dielectric layers are arranged roughly parallel to one another as in the first embodiment. It is noted that the angle of inclination of each dielectric layer should preferably be an angle of inclination within an angle of, for example, 45 degrees with respect to a plane perpendicular to the lengthwise direction of the waveguide 810. Moreover, the inclination of each dielectric layer is also effective not only in one direction but also in two directions in the film plane.

Moreover, in the present second embodiment, the Bi—Ca—Nb—O based dielectric ceramic material (BCN: relative permittivity=59, tan $\delta=2.33\times10^{-4}$) is used as the high-permittivity ceramic material and the Al—Mg—Sm—O based dielectric ceramic material mixed with glass (AMSG: relative permittivity=7.4, tan $\delta=1.11\times10^{-4}$) is used as the low-permittivity ceramic material as in the first embodiment. Moreover, a dielectric ceramic material (relative permittivity=7) constituted of a crystalline layer made of $MgSiO_4$ and an Si—Ba—La—B—O based glass layer, a MgO—CaO—$TiO_2$ based material or the like can be used besides the materials.

The number of layers and the physical properties of permittivity and so on of the high-permittivity ceramic layers 802, 804 and 806 and the low-permittivity ceramic layers 803 and 805 in the dielectric multilayer structure are not limited to the values described above but allowed to take various modes. Particularly, with regard to the number of layers, the dielectric multilayer structure needs to be formed by layering two or more dielectric layers of different relative permittivities, as exemplified by the dielectric multilayer structure formed of five layers in the present third embodiment.

The manufacturing method of the dielectric filter 801 is described next. First of all, the high-permittivity ceramic layers 802, 804 and 806 in a greensheet (non-sintered sheet) state formed of BCN of the high-permittivity ceramic material and the low-permittivity ceramic layers 803 and 805 in a greensheet state formed of AMSG of the low-permittivity ceramic material are alternately layered, and the layers are crimped together with a pressure of 29.4 MPa applied at a temperature of 40° C. Subsequently, the layers are heated at any temperature within a range of 800° C. to 1000° C. or more preferably within a range of 850° C. to 950° C. with further pressurization, sintering the layers together (hot pressing process). Through this process, the high-permittivity ceramic layers 802, 804 and 806 and the low-permittivity ceramic layers 803 and 805 are sintered in the state in which the layers are closely fit together and layered, allowing the integrated dielectric multilayer structure to be formed for the manufacturing of the dielectric filter 801. The manufacturing method of the dielectric multilayer structure in the dielectric filter 801 is roughly similar to the method described in connection with the first embodiment. However, by employing the greensheet of which the thickness is inclinatorily changed and inclinatorily changing the crimping pressure in the direction along the junction planes of the dielectric layers in order to make the dielectric layers have the wedge-like cross-sectional shape, the wedge-like configuration of each dielectric layer can be obtained.

Figure 18:
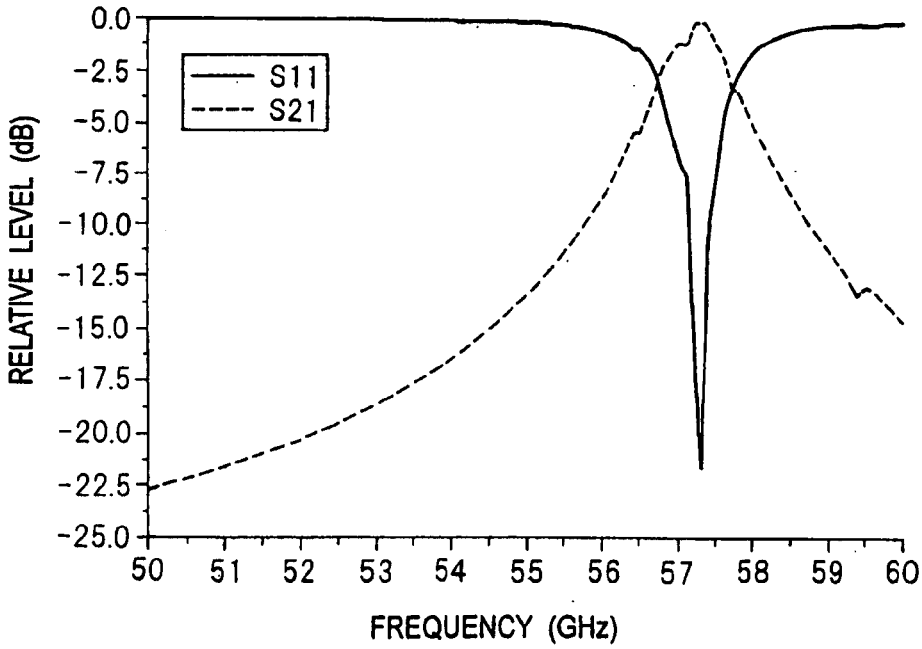
FIG. 18 is a plot chart showing the filter characteristics of the dielectric filter of FIG. 17.

The transmission characteristic S21 and the reflection characteristic S11 of the filter in the thus produced dielectric filter 801 were measured by the network analyzer (37200B of Anritsu) used in the first embodiment. FIG. 18 shows the measurement results. In FIG. 18, the horizontal axis represents frequency (GHz), and the vertical axis represents attenuation (dB). As shown in FIG. 18, it can be understood that the transmission frequency is about 57.3 GHz since the lower end point of the reflection characteristic S11 and the upper end point of the transmission characteristic S21 are located at a frequency of about 57.3 GHz. Moreover, there was a loss of about 0.2 dB at the transmission frequency. Moreover, when the formation thickness of each dielectric layer has been constant (FIG. 9 of the first embodiment), the return loss has been about −15 dB. In contrast to this, the return loss is about −22 dB in the present second embodiment, and this clearly indicates that the reflection loss due to the surfaces of the dielectric layers in the transmission band is reduced. The reason why the above filter characteristic is obtained is that electric fields are concentrated on the portion where the layer formation thickness is thin when electric fields propagate inside the dielectric layer.

Moreover, it is desirable to increase the cyclicity (about eight cycles) of the dielectric ceramic materials to be selected in order to obtain a steeper transmission characteristic also in the present second embodiment as in the first embodiment. In the above case, it is necessary to form the dielectric multilayer structure paying attention to the thermal contraction coefficient of the single layer of the dielectric ceramic materials and its contraction factor after sintering. The above is intended to prevent in advance defective sintering owing to the occurrence of separation due to heating in the hot pressing process.

Although the case where the dielectric filter 801 is inserted in the waveguide 810 and formed as the waveguide type dielectric filter 801 in the present second embodiment has been described, it is also possible to form a chip type dielectric filter as shown in the first embodiment instead of the above case.

According to the second embodiment, in addition to the effect of the above embodiments, by further intentionally changing the formation thickness of the dielectric layers in forming the dielectric multilayer structure, the electric fields can be concentrated on the portion where the formation thickness of each dielectric layer is thin when electric fields propagate inside the dielectric layer, and this allows the provision of a dielectric filter having filter characteristics such that the reflection loss due to the surfaces of the dielectric layers in the transmission band is reduced.

THIRD EMBODIMENT

Figure 19:
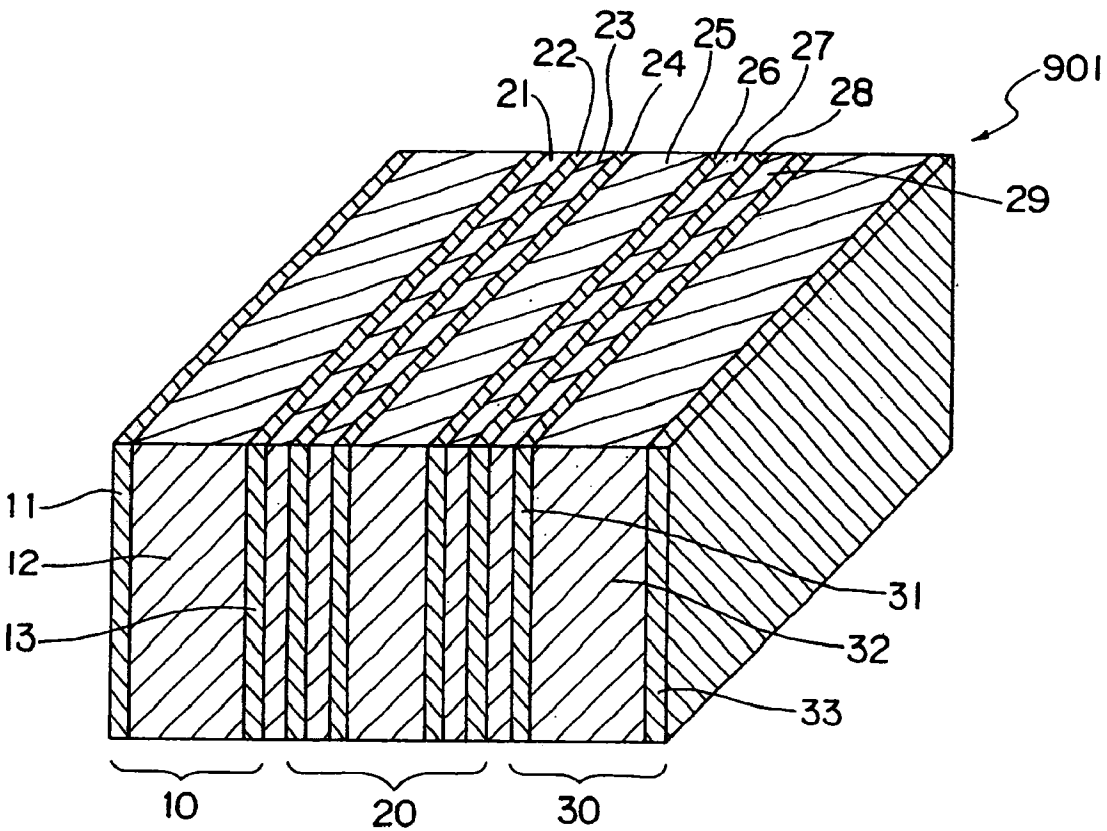
FIG. 19 is a schematic explanatory view showing the construction of a dielectric filter (in which no metal electrode is formed) according to a third embodiment of the present invention.

A dielectric filter 901 of one example of the dielectric filter manufactured by the dielectric filter and the dielectric filter manufacturing method according to the third embodiment of the present invention is described next. The dielectric filter 901 is an example of the dielectric filter formed by connecting in series a plurality of dielectric filters (e.g., dielectric filters 401) of the first embodiment. FIG. 19 shows a schematic explanatory view showing the structure of the dielectric filter 901.

As shown in FIG. 19, the dielectric filter 901 has a structure in which three dielectric multilayer structures of a first multilayer ceramic structure 10, a second multilayer ceramic structure 20 and a third multilayer ceramic structure 30, which are the dielectric multilayer structures, are connected in series. Moreover, each of the dielectric multilayer structures is formed by alternately layering high-permittivity ceramic layers 11, 13, 22, 24, 26, 28, 31 and 33 formed of a high-permittivity ceramic material and low-permittivity ceramic layers 12, 21, 23, 25, 27, 29 and 32 formed of a low-permittivity ceramic material as described in connection with each of the embodiments.

Moreover, in the present third embodiment, the Bi—Ca—Nb—O based dielectric ceramic material (BCN: relative permittivity=59, tan $\delta=2.33\times10^{-4}$) is used as the high-permittivity ceramic material, and the Al—Mg—Sm—O based dielectric ceramic material mixed with glass (AMSG: relative permittivity=7.4, tan $\delta=1.11\times10^{-4}$) is used as the low-permittivity ceramic material. Moreover, a dielectric ceramic material (relative permittivity=7) constituted of a crystalline layer made of $MgSiO_4$ and an Si—Ba—La—B—O based glass layer, an MgO—CaO—$TiO_2$ based material or the like can also be used besides these materials.

The number of layers and the physical properties of permittivity and so on of the dielectric ceramic materials are not limited to the values but allowed to take various modes. Particularly, with regard to the number of layers, the dielectric multilayer structure needs to be formed by layering two or more dielectric layers of different relative permittivities.

Moreover, the formation method of the dielectric filter 901 of the present third embodiment is similar to the method describe in connection with the first embodiment. In this case, by individually sintering the multilayer ceramic structures 10, 20 and 30 and thereafter resintering the multilayer ceramic structures 10, 20 and 30 while crimping together the layers via low-permittivity ceramic layers 21 or 29, the multilayer ceramic structures 10, 20 and 30 can be integrated with one another. Moreover, it may be a case where the dielectric layers are layered and integrally formed by one-time sintering instead of the above case. However, when the number of layers to be layered is increased, the separation and cracks easily occur during the sintering. Therefore, it is desirable to form an integrated dielectric filter by individually sintering the multilayer ceramic structures and thereafter connecting the structures.

Moreover, although the dielectric ceramic materials are used as the materials that form the dielectric layers in the present third embodiment, it is, of course, possible to use a composite material or the like in which fine particles of dielectric of $TiO_2$, $Al_2O_3$ or the like are dispersed in the resin material of fluorocarbon resin, polycarbonate or the like.

Moreover, a method for cutting ceramic plates out of a dielectric ceramic in a bulk form and bonding the plates together is also possible. However, for the reason that high-accuracy processing of cutting, polishing or the like is necessary during the cutting of the plate-shaped ceramic materials and the reason that a dimensional error easily occurs in the bonding process and the permittivity of the interface changes when an epoxy based resin or a low melting point glass material is used as an adhesive in bonding the dielectric materials, the filter characteristics of the dielectric filter to be manufactured are sometimes adversely affected. For the above reasons, it is desirable to adopt the manufacturing method described above or the method of using the composite material in the present fourth embodiment.

Moreover, with regard to the formation thickness of each of the layers in the thus-produced dielectric filter 901, the high-permittivity ceramic layers 11, 13, 31 and 33 have a formation thickness of 0.179 mm, and the low-permittivity ceramic layers 12 and 32 have a formation thickness of 4.044 mm in the first multilayer ceramic structure 10 and the third multilayer ceramic structure 30. Moreover, the high-permittivity ceramic layers 22, 24, 26 and 28 have a formation thickness of 0.179 mm, the low-permittivity ceramic layers 23 and 27 have a formation thickness of 0.5055 mm, and the low-permittivity ceramic layer 25 that also serves as the intermediate layer has a formation thickness of 3.033 mm in the second multilayer ceramic structure 20. It is noted that the formation thickness of each of the low-permittivity ceramic layers 21 and 29 that connect the multilayer ceramic structures 10, 20 and 30 is 0.5055 mm. Moreover, the loaded Q value of the first multilayer ceramic structure 10 and the third multilayer ceramic structure 30 in the above construction is 118 (non-loaded Q value is 6900), and the loaded Q value of the second multilayer ceramic structure 20 is 57 (non-loaded Q value is 4400).

The first embodiment and the second embodiment include only one dielectric multilayer structure, and the intermediate layer should desirably be made of a high permittivity material in such a case. However, when many multilayer ceramic structures are connected together like the dielectric filter 901 of the present third embodiment, the intermediate layer should desirably be made of a low-permittivity material for the reason that ripples in the transmission band can be reduced.

Figure 20:
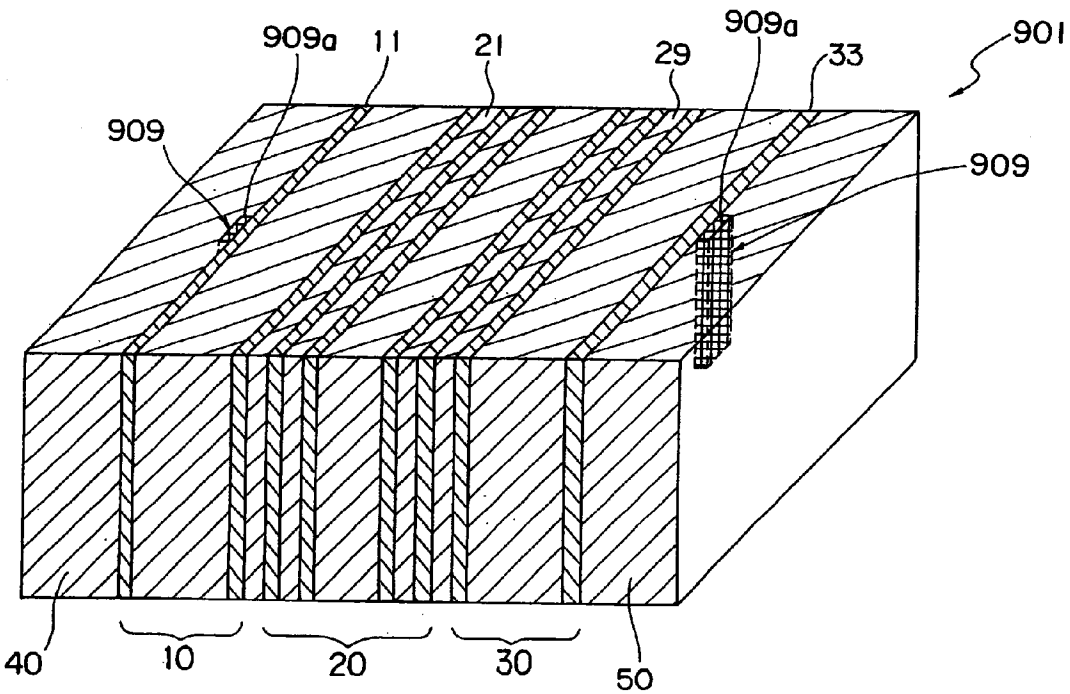
FIG. 20 is a schematic explanatory view of an internal structure in which a metal electrode is formed in the dielectric filter of FIG. 19.
Figure 21:
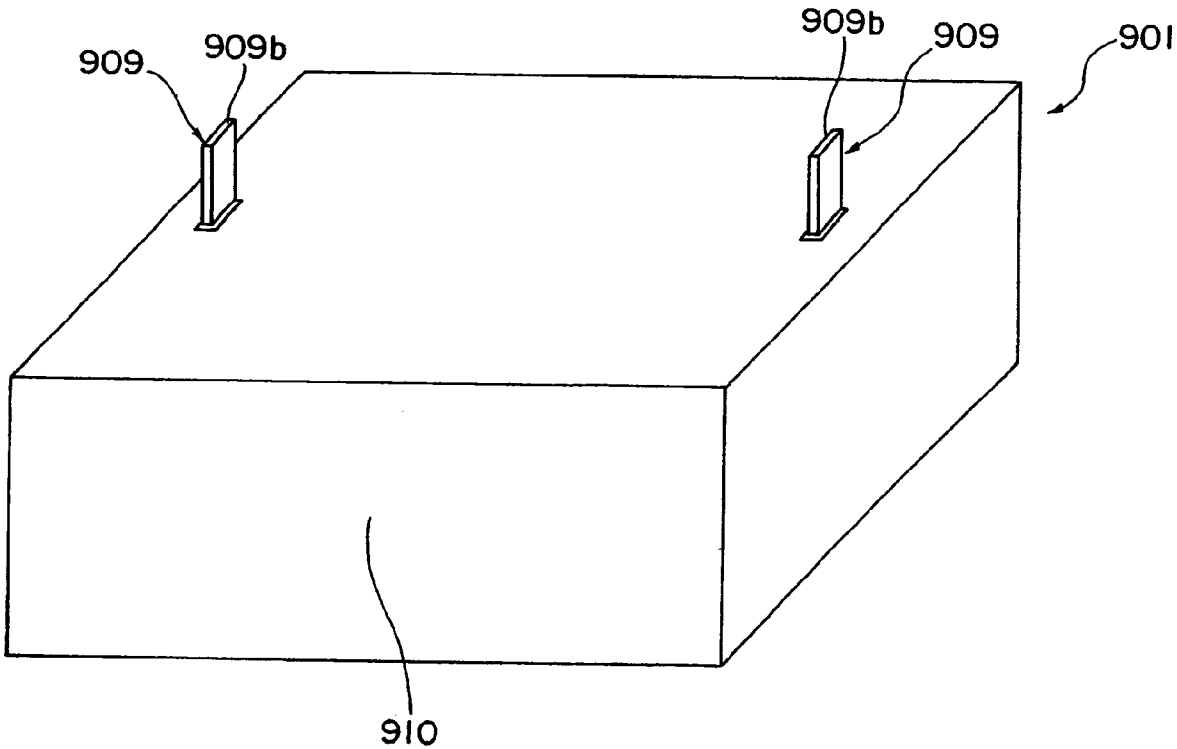
FIG. 21 is a schematic view of the external appearance of the dielectric filter of FIG. 20.

FIGS. 20 and 21 show schematic explanatory views showing a structure in which metal electrodes 909 of one example of the feeding electrode are formed in the multilayer ceramic structure of the dielectric filter 901.

As shown in FIG. 20, internal electrodes 909*a*, which become part of the metal electrodes 909, are formed on the outer surface of the high-permittivity ceramic layer 11 in the first multilayer ceramic structure 10 and the outer surface of the high-permittivity ceramic layer 33 in the third multilayer ceramic structure 30. Moreover, low-permittivity ceramic layers 40 and 50 are formed on the outer surface of the high-permittivity ceramic layer 11 and the outer surface of the high-permittivity ceramic layer 33, forming a structure in which the inner electrodes 909*a* are buried in the respective low-permittivity ceramic layers 40 and 50. Moreover, since the formation thickness of each of the low-permittivity ceramic layers 40 and 50 becomes a distance between the end surface of the high-permittivity ceramic layer 11 or 33 of the inner electrode 909*a* and the terminal end of each of the low-permittivity ceramic layers 40 and 50, it is necessary to determine the formation thickness of each of the layers so that the impedance of each of the inner electrodes 909*a* becomes about 50 ohms. In general, the distance is often determined as a distance of about $\lambda g/4\sqrt{\epsilon}$, and the formation thickness of each of the low-permittivity ceramic layers 40 and 50 is set to about 500 μm in the present fourth embodiment. It is to be noted that one end of each of the inner electrodes 909*a* is exposed from the outer surface of the dielectric filter 901.

Further, as shown in FIG. 21, after the dielectric filter 901 that includes the inner electrodes 909*a* are formed, the waveguide 910 (or metal thin film 910) of one example of the shield portion formed of a metal is formed so as to cover the entire outer surface of the dielectric filter 901 excluding the exposed portions of the inner electrodes 909*a*. In addition, the outer electrodes 909*b* formed of a similar metal material are formed connected to the exposed portions of the inner electrodes 909*a*, forming the metal electrodes 909 in a state in which the electrodes project from the outer surface of the dielectric filter 901. It is desirable to form the waveguide 910 by applying a metal paste obtained by mixing metal powder with an organic solvent or depositing the paste by the electron-beam evaporation method, the sputtered method or the like on the outer surface of the dielectric filter 901.

Moreover, when the dielectric ceramic material used for the LTCC (Low Temperature Co-fired Ceramic) board including AMSG, BCN, ZTG and BNT used in the present embodiment are used, the sintering temperature can be lowered. Therefore, a metal of silver and copper systems of high specific conductance can be used as the inner electrodes, and this is more desirable.

Figure 22:
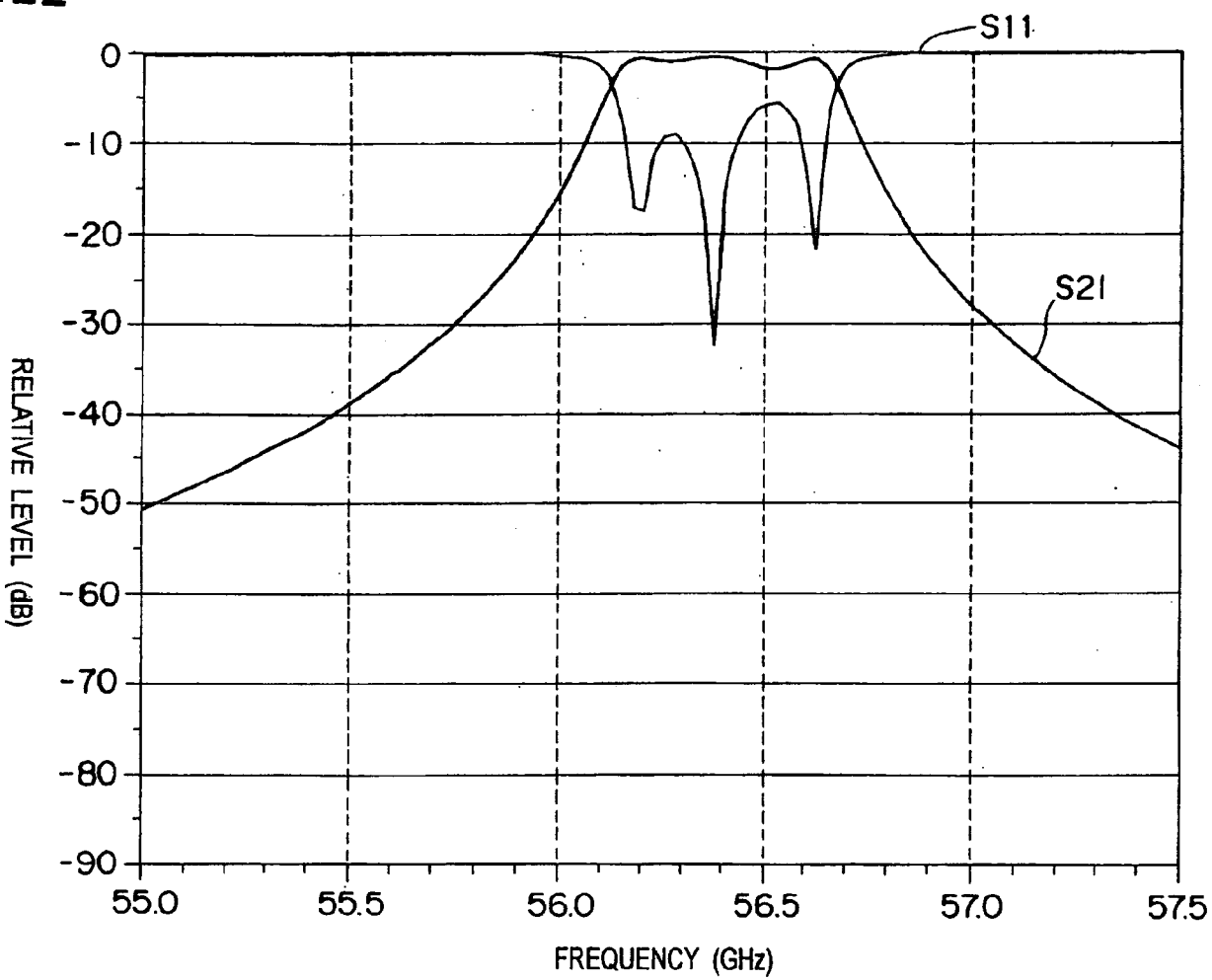
FIG. 22 is a plot chart showing the filter characteristics of the dielectric filter of FIGS. 20 and 21.
Figure 23A:
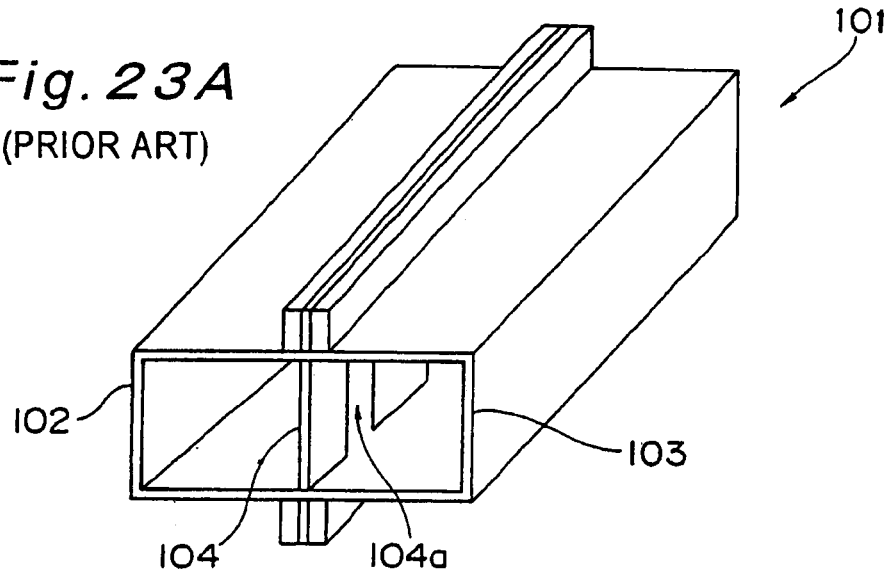
Fig. 23A (PRIOR ART)
FIGS. 23A and 23B are perspective views showing a conventional waveguide type filter, where
Figure 23B:
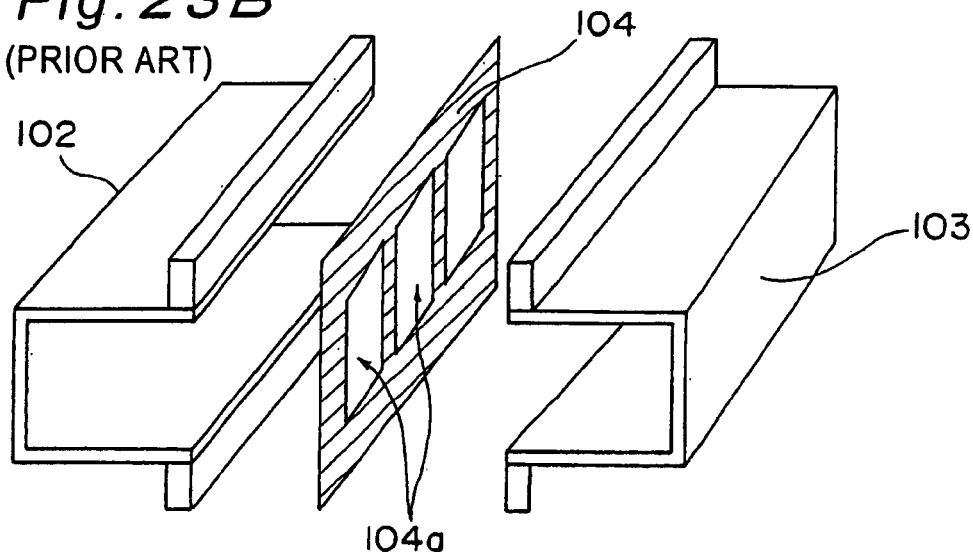
Fig. 23B (PRIOR ART)
Figure 24:
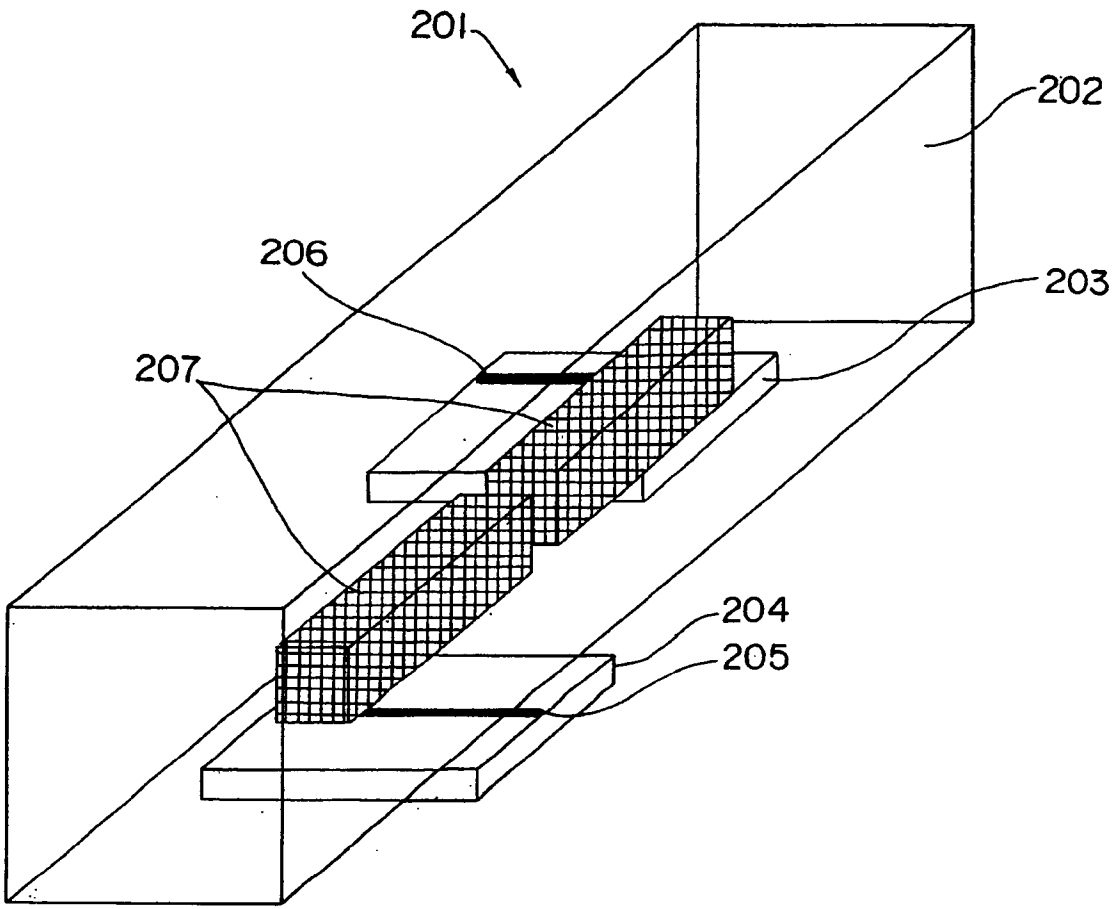
Fig. 24 (PRIOR ART)
FIG. 24 is a see-through perspective view of a conventional millimeter-wave band filter.

The chip type dielectric filter 901, in which the metal electrodes 909 are formed on the dielectric filter 901 and the outer surface of which is shielded by the waveguide 910, is completed. The transmission characteristic S21 and the reflection characteristic S11 of the filter in the thus produced chip type dielectric filter 901 were measured by the network analyzer (37200B of Anritsu) used in the first embodiment. FIG. 22 shows the measurement results. In FIG. 22, the horizontal axis represents frequency (GHz), and the vertical axis represents attenuation (dB). As shown in FIG. 22, it can be understood that the transmission frequency is about 56.4 GHz since the lower end point of the reflection characteristic S11 and the upper end point of the transmission characteristic S21 are located at a frequency of about 56.4 GHz. Moreover, there was a loss of not greater than 0.5 dB at the transmission frequency, and a reflection characteristic of 50 dB was obtained in terms of attenuation at the cutoff frequency. A transmission band (frequency bandwidth at −3 dB) of about 600 MHz (56.1 GHz to 56.7 GHz) was further obtained.

Although the junction surfaces of the dielectric layers are formed so as to be roughly parallel to one another in the dielectric filter 901 in the present third embodiment, the present invention is not limited to the case, and it is sometimes more preferable that the dielectric layers are in a tapered shape (nonparallel) as in the dielectric filter 810 of the second embodiment instead of the above case. Moreover, it is needless to say that the shape of each metal electrode 909 is not limited to the shape shown in FIGS. 20 and 21 but allowed to take various modes besides it.

According to the third embodiment, the effects of the first through third embodiments can be obtained. In addition, the dielectric filter 901 of the third embodiment is able to assure a wide transmission band, which has been difficult in the dielectric filter formed of one dielectric multilayer structure as in the first embodiment and the second embodiment and to obtain excellent characteristics of, for example, a filter for wireless communications.

Moreover, in the dielectric filter 901, by forming the metal electrode 909 in each of the first multilayer ceramic structure 10 and the third multilayer ceramic structure 30 and forming the metal thin film 910 so that the film covers the entire outer surface of the dielectric filter 901 for shielding between the dielectric filter 901 and its outside, the waveguide-to-microstrip conversion can be eliminated, so that a chip type dielectric filter, which can be further reduced in size, can be formed. Therefore, a dielectric filter, for use in the microwave band or the millimeter-wave band, which can be directly mounted on a subminiature circuit board and necessitates no processing of the dielectrics and the casing for which very high processing accuracy is required.

FOURTH EMBODIMENT

A dielectric filter of one example of the dielectric filter manufactured according to the dielectric filter and the dielectric filter manufacturing method of the fourth embodiment of the present invention is described next. Because the feeding electrode owned by the dielectric filter has a characteristic structure, the structure of the feeding electrode is mainly described as follows. It is to be noted that the construction of the dielectric multilayer except for the feeding electrode, i.e., the structure of the dielectric multilayer structure that is the layer structure of the dielectric layers and the constructions of the position and so on of the feeding electrode to be arranged in the dielectric multilayer structure can take a construction similar to that of the dielectric filters of the first embodiment through the third embodiment.

Figure 25:
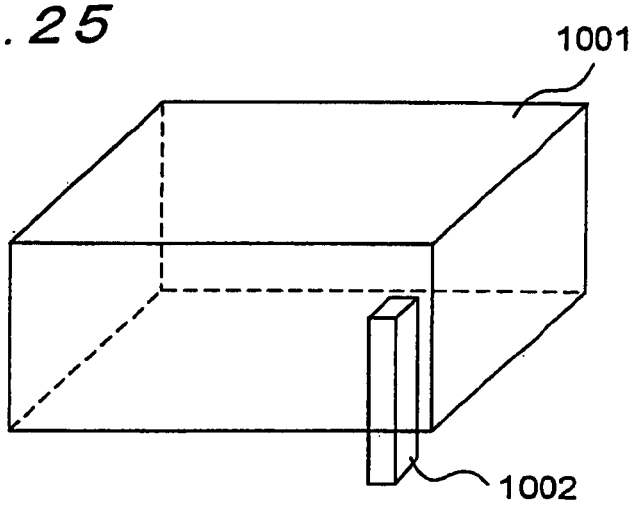
FIG. 25 is a schematic perspective view of a dielectric filter in a state in which a rectangular electrode according to one example of the fourth embodiment of the present invention is employed.
Figure 28:
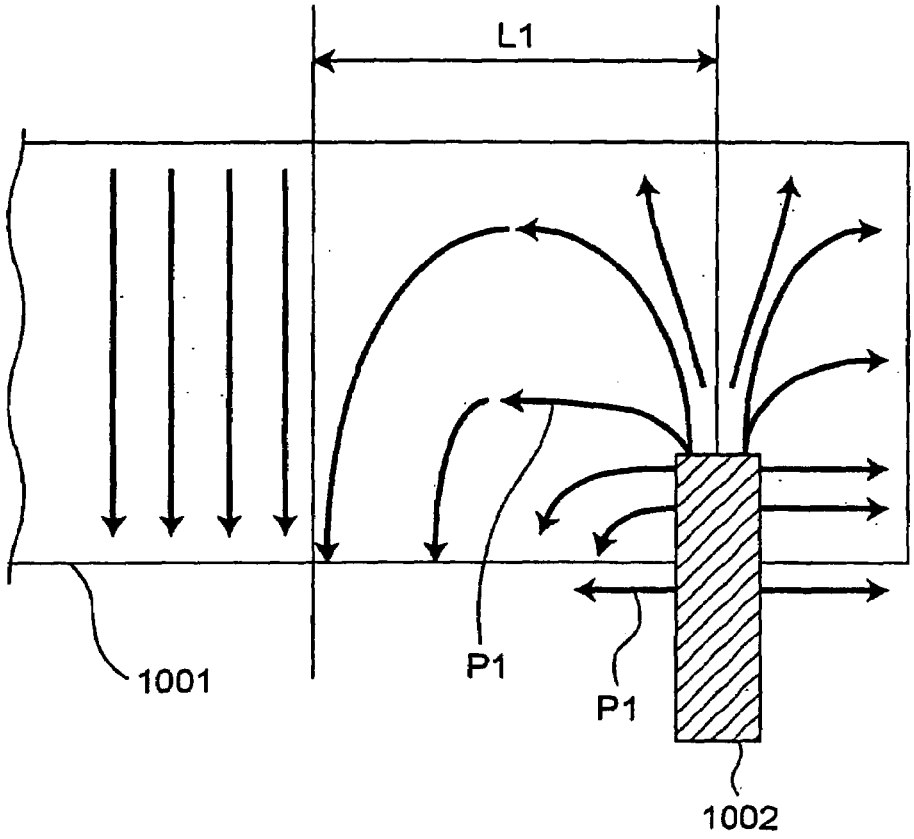
FIG. 28 is a schematic view showing electric lines of force in the dielectric filter of FIG. 25.

First of all, FIG. 25 shows a schematic explanatory view of a dielectric filter according to one example of the present fourth embodiment showing a state in which a rectangular electrode 1002 of one example of the feeding electrode is employed for the dielectric filter 1001 of each of the embodiments. Further, FIG. 28 shows a schematic explanatory view showing electric lines of force P1 generated in the dielectric filter 1001 when a prescribed electric potential is applied to the rectangular electrode 1002 in the case where the rectangular electrode 1002 as shown in FIG. 25 is employed for the dielectric filter 1001. FIG. 28 is a schematic explanatory view that uses the vertical cross-section shape in the direction in which the dielectric layers are layered in the dielectric filter 1001 of FIG. 25.

As shown in FIG. 28, electric lines of force P1 are generated from portions that serve as the edge portions of a quadrangular prism that constitutes the rectangular electrode 1002. Therefore, electric lines of force P1 are generated in the transverse direction in the figure from the edge portions that are the connection portions of the illustrated side surfaces of the rectangular electrode 1002, and electric lines of force P1 are generated in the upward direction or a direction inclined from the upward direction from the edge portions in the neighborhood of the illustrated upper surface of the rectangular electrode 1002. By virtue of the formation of the electric lines of force P1, disorder of the electric lines of force occurs in a wide range in the neighborhood of the rectangular electrode 1002, and a distance L1 as shown in FIG. 28 is needed until the desired $TE_{10}$ mode is obtained in the dielectric filter 1001. The necessity of securing the distance L1 is to cause the problem of an increase in the size of the dielectric filter 1001 and an increase in the transmission loss because the field emission in the course of introduction into the dielectric filter 1001 is great (i.e., great field emission is achieved also from the portions other than the portion where the rectangular electrode 1002 is inserted and placed in the dielectric filter 1001).

Figure 26:
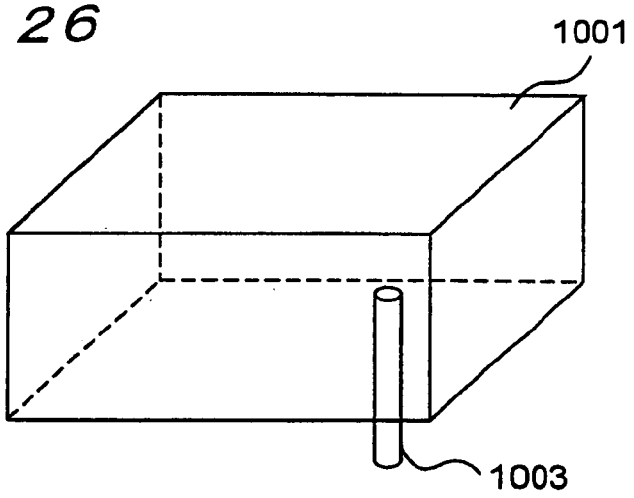
FIG. 26 is a schematic perspective view of a dielectric filter in a state in which a columnar electrode according to another example of the fourth embodiment is employed.
Figure 29:
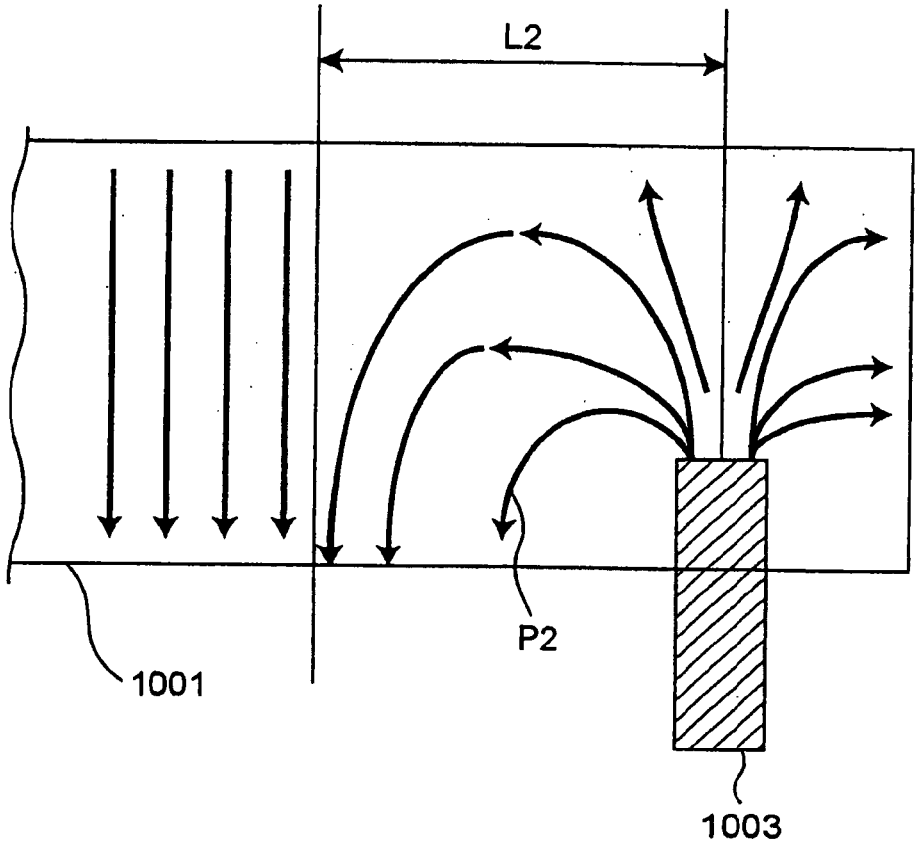
FIG. 29 is a schematic view showing electric lines of force in the dielectric filter of FIG. 26.

Next, FIG. 26 shows a schematic explanatory view of a dielectric filter according to another example of the present fourth embodiment showing a state in which a columnar electrode 1003 of another example of the feeding electrode is employed for the dielectric filter 1001 of each of the embodiments. Further, FIG. 29 shows a schematic explanatory view showing electric lines of force P2 generated in the dielectric filter 1001 when a prescribed electric potential is applied to the columnar electrode 1003 in the case where the columnar electrode 1003 as shown in FIG. 26 is employed for the dielectric filter 1001. FIG. 29 is a schematic explanatory view that uses the vertical cross-section shape in the direction in which the dielectric layers are layered in the dielectric filter 1001 of FIG. 26.

As shown in FIG. 29, electric lines of force P2 are generated not from the peripheral surface portions of the cylindrical column but from the end face portions of the cylindrical column in the columnar electrode 1003. Therefore, the electric lines of force P2 are generated in the upward direction or a direction inclined from the upward direction from the upper surface of the columnar electrode 1003. With the electric lines of force P2 thus formed, it can be understood that field emission in the course of introduction from the columnar electrode 1003 into the dielectric filter 1001 is small and the transmission loss can be reduced, and the field distribution is somewhat improved in comparison with the field distribution in the rectangular electrode 1002 of FIG. 28. However, a distance L2 until the desired $TE_{10}$ mode is obtained in the dielectric filter 1001 is roughly equal to the distance L1 in the case of the rectangular electrode 1002. Accordingly, there is a problem that it is difficult to reduce the size of the dielectric filter 1001 even when the columnar electrode 1003 is employed.

Accordingly, a dielectric filter according to a more preferable example of the present fourth embodiment, in which the dielectric filter configuration is further reduced in size by reducing the required distance until the $TE_{10}$ mode is obtained in the dielectric filter by concurrently reducing the transmission loss in the feeding electrode and reducing the disorder of the electric lines of force generated around the feeding electrode, giving solution to the problems based on the structural features of the feeding electrode while achieving the object of the present invention, is described below.

Figure 27:
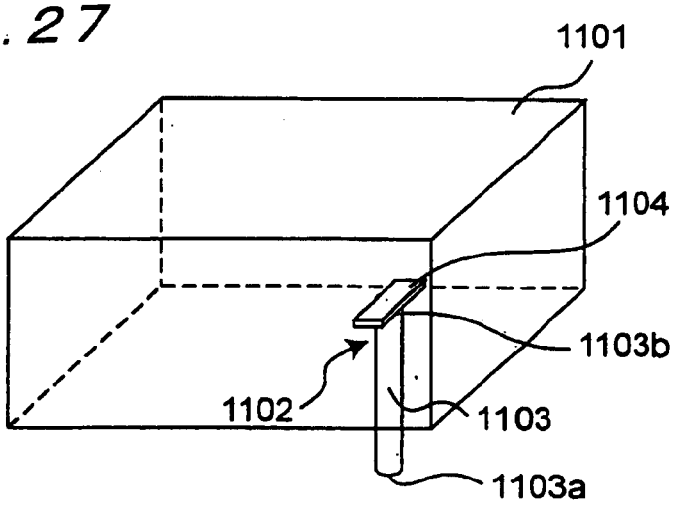
FIG. 27 is a schematic perspective view of a dielectric filter in a state in which an electrode according to a more preferable example of the fourth embodiment is employed.

FIG. 27 shows a schematic explanatory view showing the schematic structure of an electrode 1102 of one example of the feeding electrode provided for a dielectric filter 1101 according to a more desirable example of the present fourth embodiment.

As shown in FIG. 27, the electrode 1102 includes a columnar electrode 1103 of one example of the columnar member that has a peripheral surface portion of a little transmission loss and a rectangular flat plate electrode portion 1104 of one example of the rectangular member that is connected to the end portion of the columnar electrode 1103 and improves the field emission characteristic at the end portion. Moreover, an end portion 1103*a* located on the lower side in the figure of the columnar electrode 1103 is exposed outside the dielectric filter 1101 and able to apply a electric potential to the end portion 1103*a*. Therefore, the end portion 1103*a* plays the role of a feeding terminal. Moreover, an end portion 1103*b* located on the upper side in the figure of the columnar electrode 1103 is located inside the dielectric filter 1101, and an approximate center portion of the rectangular flat plate electrode portion 1104 is connected to the end portion 1103*b*. Moreover, the columnar electrode 1103 has its axial center located so as to be roughly perpendicular to the direction in which the dielectric layers are layered in the dielectric filter 1101, and the rectangular flat plate electrode portion 1104 is located also extending so as to be roughly perpendicular to the axial center of the columnar electrode 1103. Therefore, the electrode 1102 constructed of the columnar electrode 1103 and the rectangular flat plate electrode portion 1104 is formed into a roughly T-figured shape as a whole. It is noted that the rectangular flat plate electrode portion 1104 is located inside the dielectric filter 1101.

The details of the dimensions, materials and so on of the electrode 1102 that has the above schematic construction are described below. The dimensions of the columnar electrode 1103 of the electrode 1102 are formed so that, for example, the input impedance becomes 50 ohms and formed of titanium metal processed so that the diameter becomes 170 μm. Moreover, the length dimension of the columnar electrode 1103 is related to the degree of input/output coupling with the dielectric filter 1101, and the input impedance is not largely changed by changing the length dimension and also not largely changed even when a rectangular flat plate structure (i.e., the rectangular flat plate electrode portion 1104) is provided at the end portion 1103*b* of the columnar electrode. Therefore, the structure can be used in common even when the shape of the end portion 1103*b* is changed. When the burial length dimension of the columnar electrode 1103 inside the dielectric filter 1101 should desirably be made about a half of the dielectric layer height since a higher-order mode comes near and the mode is disordered when the length dimension exceeds a half of the dielectric layer height (i.e., dimension in the vertical direction in FIG. 27).

The structure of the rectangular flat plate electrode portion 1104 of the electrode 1102 is described in detail next with reference to the enlarged schematic view of the electrode 1102 shown in FIG. 30 and the schematic explanatory view of FIG. 31.

Figure 30:
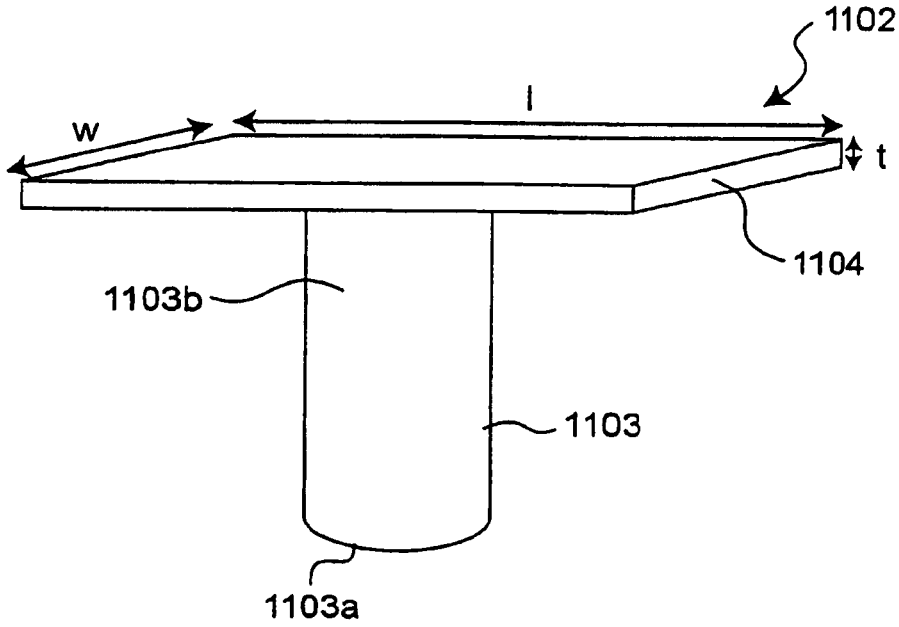
FIG. 30 is a schematic enlarged view of the electrode of FIG. 27.
Figure 31:
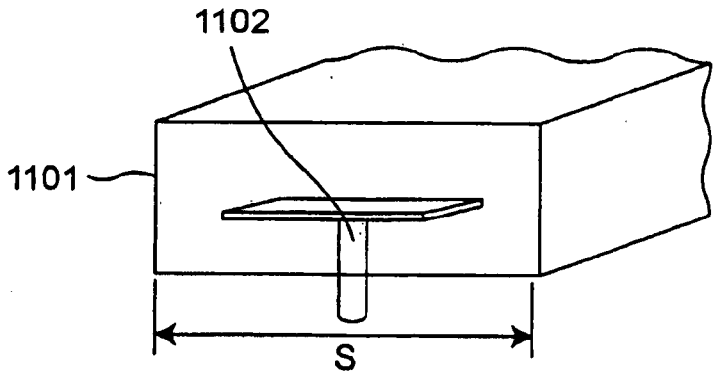
FIG. 31 is a schematic explanatory view of the electrode and the dielectric filter for explaining the dimensions of the electrode of FIG. 30.

As shown in FIG. 30, the rectangular flat plate electrode portion 1104 is connected to the end portion 1103*b* on the upper side of the columnar electrode 1103 at the approximate center portion of the flat plate shape, and a width dimension w of the rectangular flat plate electrode portion 1104 should desirably be equal to the diameter of the columnar electrode 1103. The reason for the above is that, when the width dimension w differs from the diameter, increased number of edge portions are to be located in the connection portion, and the points at which electric lines of force are generated are increased, causing the disorder of electric lines of force.

Moreover, the length dimension 1 of the rectangular flat plate electrode portion 1104 should desirably be not greater than 85% of the dielectric width S of the dielectric filter 1101. The reason for the above is that the possibility of the occurrence of contact between the end portion of the electrode 1102 and the metal thin film formed on the outer surface of the dielectric filter 1101 is increased, and it is obvious that the dielectric filter does not play its role if such contact occurs. Moreover, in the case where the length dimension 1 of the rectangular flat plate electrode portion 1104 is not made approximately equal to the dielectric width S but made not higher than 85% of the dielectric width S, the reflection of the input signal becomes great, and therefore, a satisfactory filter characteristic cannot be obtained. For the above reasons, the length dimension 1 of the rectangular flat plate electrode portion 1104 should desirably be within a range of not smaller than the diameter dimension of the columnar electrode 1103 and not greater than 85% of the dielectric width S.

Furthermore, in consideration of production easiness and input-to-output characteristics of the rectangular flat plate electrode portion 1104, a thickness dimension t of the rectangular flat plate electrode portion 1104 should desirably be within a range of not smaller than 50 μm and not greater than a half of the dielectric height and more desirably be within a range of not smaller than 100 μm and not greater than the width dimension w of the rectangular flat plate electrode portion 1104.

Figure 32:
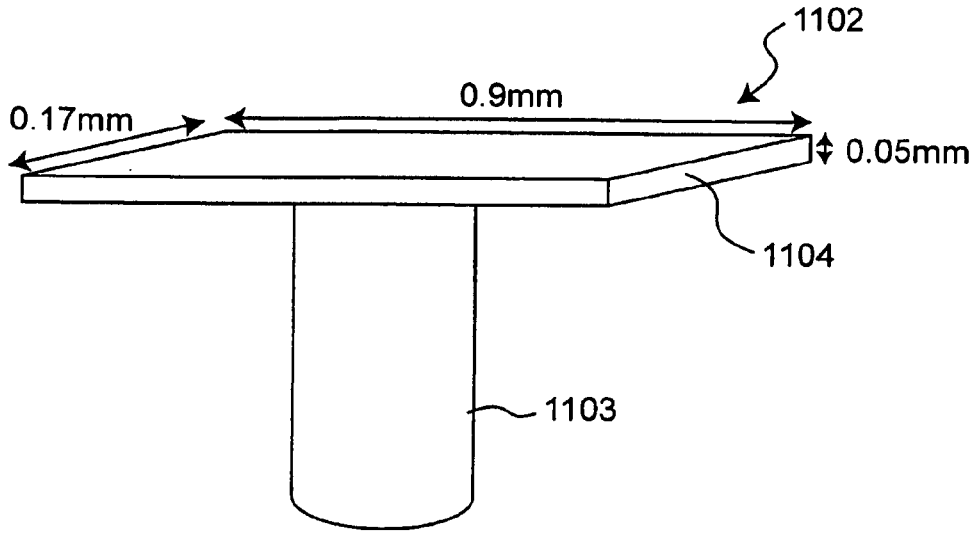
FIG. 32 is a schematic explanatory view of the dimensions of the electrode of the best mode of the fourth embodiment.
Figure 33:
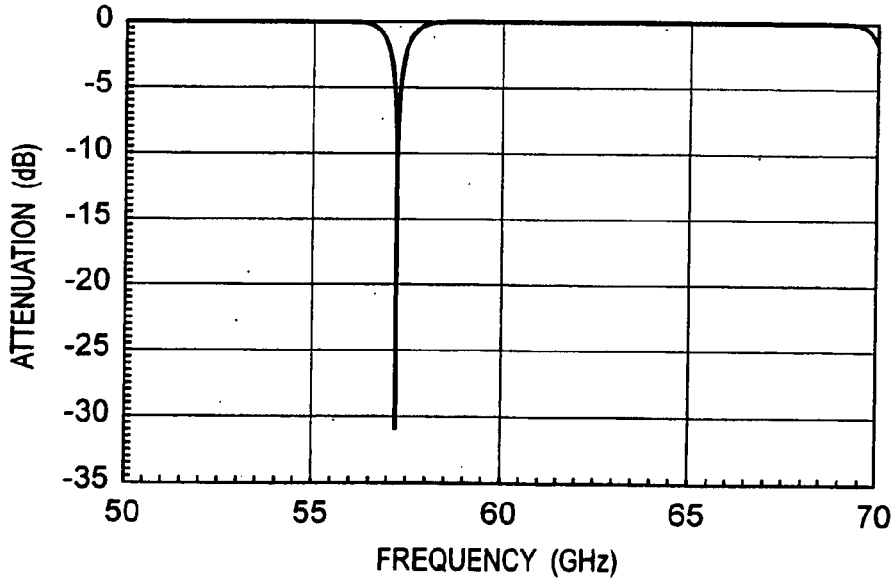
FIG. 33 is a plot chart showing the filter characteristic of the dielectric filter of FIG. 32.

FIG. 32 shows a schematic view of the shape of the electrode 1102 designed in the optimum state as an example of the electrode 1102 of the present fourth embodiment, and FIG. 33 shows the reflection characteristic of the dielectric filter 1101 in which the electrode 1102 is formed.

Although not shown in FIG. 32, the outside dimensions of the dielectric filter 1101 in which the electrode 1102 is formed are 1.253 mm×0.625 mm×3 mm in length, width and height, respectively, which are the dimensions in the direction in which the dielectric layers are layered.

As shown in FIG. 32, the diameter dimension of the columnar electrode 1103 is 0.17 mm, and the rectangular flat plate electrode portion has a width dimension w of 0.17 mm, a length dimension 1 of 0.9 mm and a thickness dimension t of 0.05 mm. When the filter characteristics of the dielectric filter 1101 are measured by applying a voltage to the electrode 1102 that has the dimensional configuration as described above, it can be understood that the reflection characteristic attains an attenuation of not smaller than −30 dB at the peak portion as shown in FIG. 33.

Figure 34:
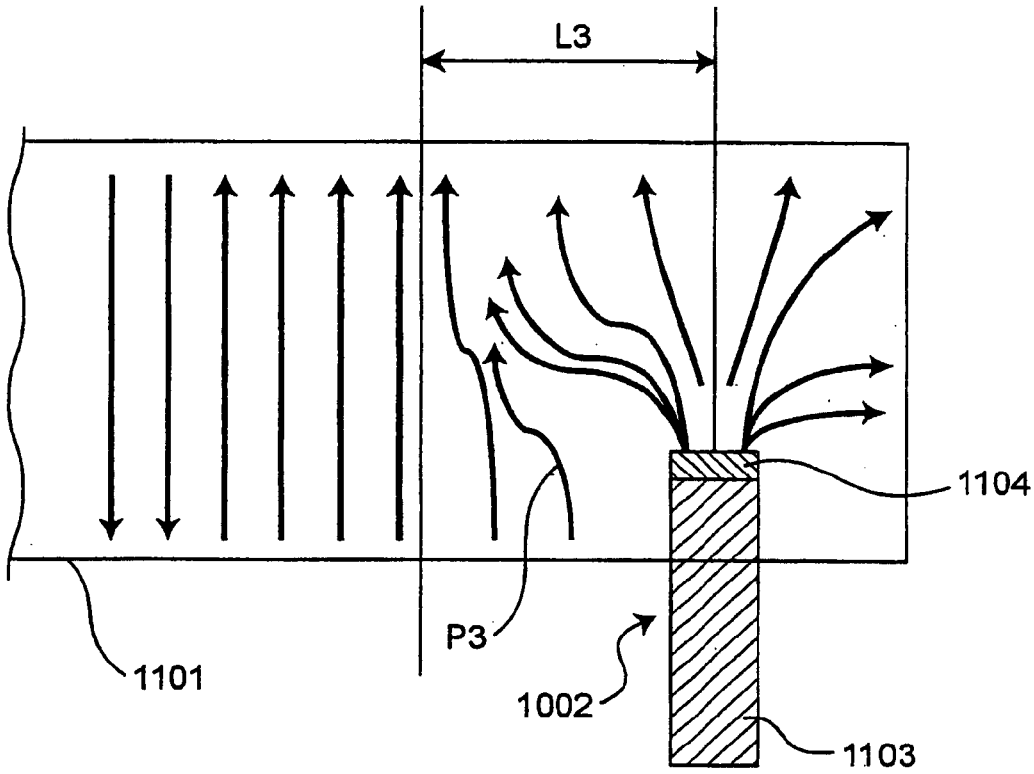
FIG. 34 is a schematic view showing electric lines of force in the dielectric filter of FIG. 27.

Moreover, FIG. 34 shows a schematic explanatory view showing electric lines of force P3 generated in the dielectric filter 1101 when electric potential is applied to the electrode 1102. FIG. 34 is a schematic explanatory view that uses the vertical cross-section shape of the direction in which the dielectric layers are layered in the dielectric filter 1101 of FIG. 27.

As shown in FIG. 34, the columnar electrode portion 1102 that constitutes the electrode 1102 has a function similar to that of the columnar electrode 1003 of the aforementioned one example. Therefore, it can be understood that no electric line of force is generated from the peripheral surface portion of the columnar electrode portion 1102, and the field emission in the course of introduction from the electrode 1102 into the dielectric filter 1101 is small, so that the transmission loss can be reduced. Moreover, electric lines of force P3 are generated on the upper side of the edge portions of the upper surface of the rectangular flat plate electrode portion 1104 connected to the end portion 1103*b* on the upper side of the columnar electrode portion 1102 or in a direction inclined from the upward direction. It can be understood that the directivity of the electric lines of forces P3 toward the upper side is intenser than in the case of the rectangular electrode 1002 shown in FIG. 28 and the columnar electrode 1003 shown in FIG. 29. Therefore, it can be understood that a distance L3 of the electrode 1102 needed until the mode is stabilized can be made shorter than the distance L1 of the rectangular electrode 1002 and the distance L2 of the columnar electrode 1003.

When the combination of the dielectric filter 1101 and the electrode 1102 that had the above dimensional configuration is used, the distance L3 until the mode stability was about 0.2 mm. On the other hand, when the columnar electrode 1003 or the rectangular electrode 1002 is used, the distance L2 or L1 needs to be 0.7 to 0.8 mm, and it can be understood that the distance L3 to the mode stability can be reduced to about a quarter of the distance when the columnar electrode 1003 or the rectangular electrode 1002 is only employed by employing the electrode 1102. The large reduction in the distance L3 to the mode stability enables the achievement of the size reduction of the dielectric filter 1101. In the dielectric filter 1101 and the electrode 1102, the satisfactory distribution of electric lines of force as described above can be obtained by adopting the dimensional ratios (i.e., dimensional ratios of length, width, height, thickness, etc.) within a range of about ±10%.

Figure 35:
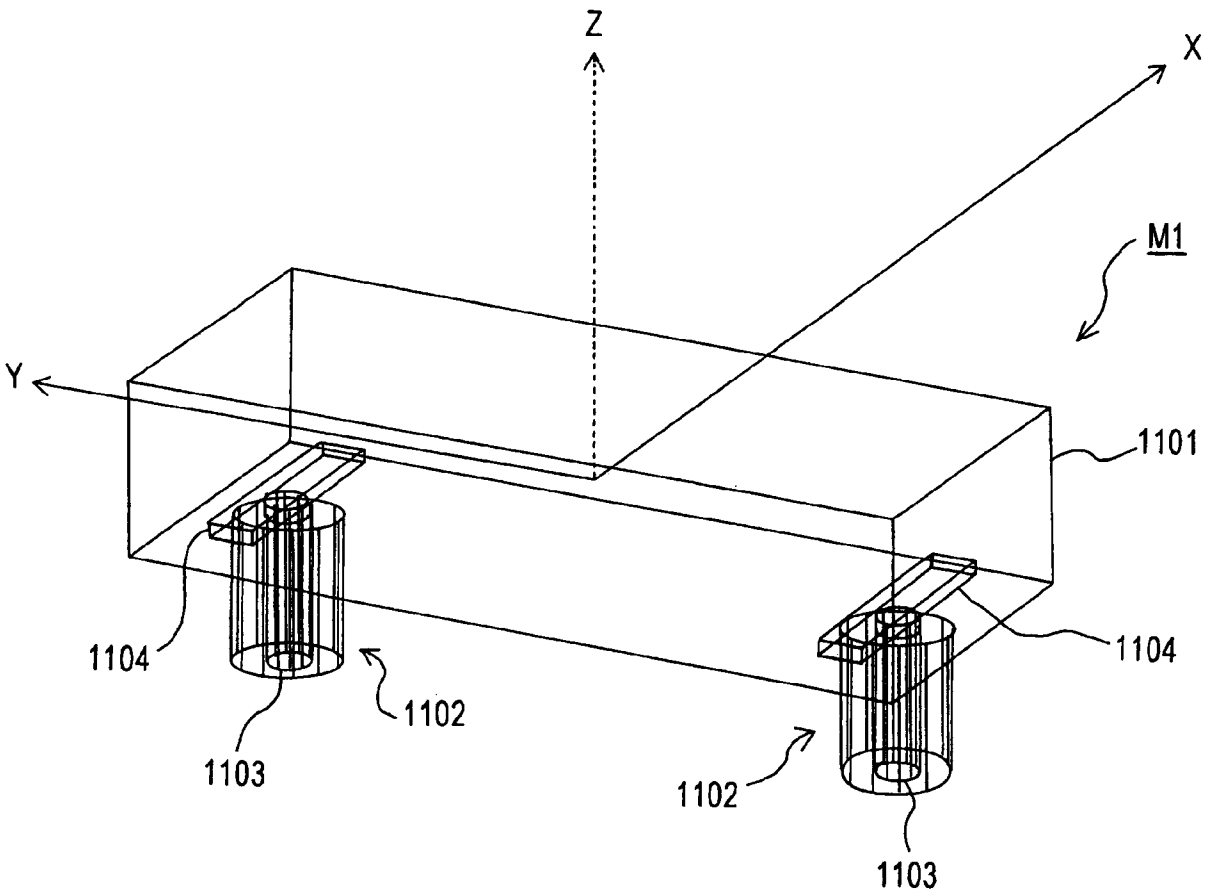
FIG. 35 is a schematic view showing an example model of the dielectric filter in which electrodes according to a more preferable example of the fourth embodiment are employed.
Figure 36:
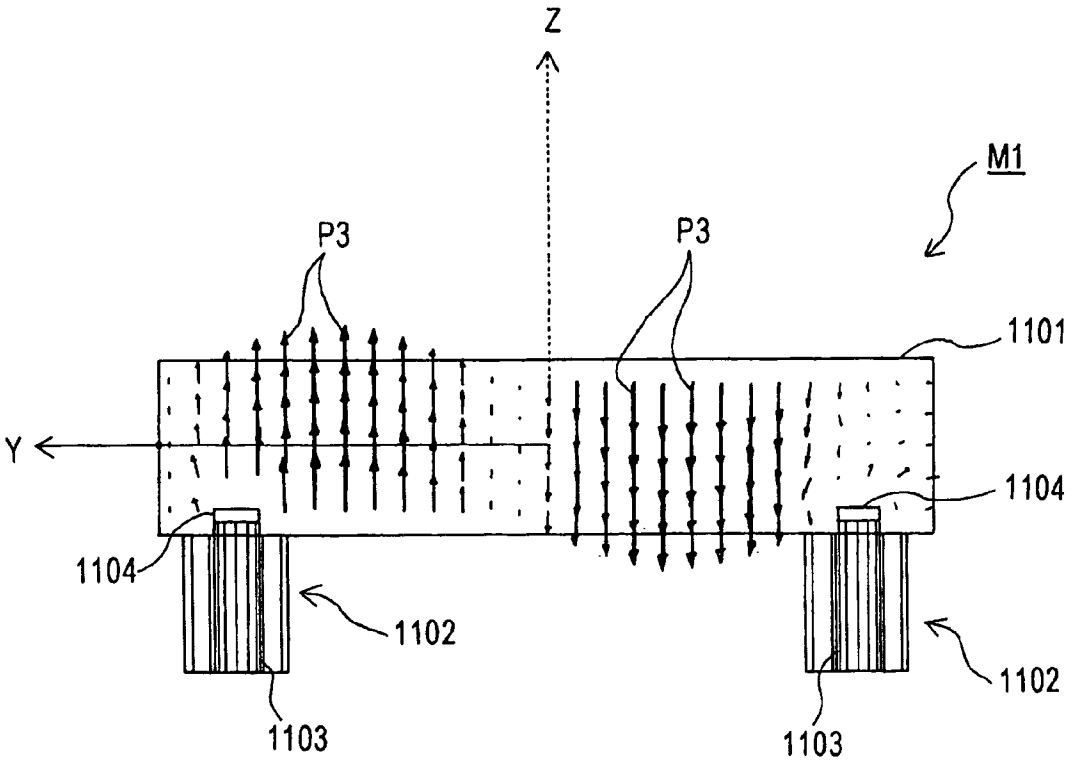
FIG. 36 is an analysis diagram showing electric lines of force in the YZ plane of the dielectric filter of FIG. 35.
Figure 37:
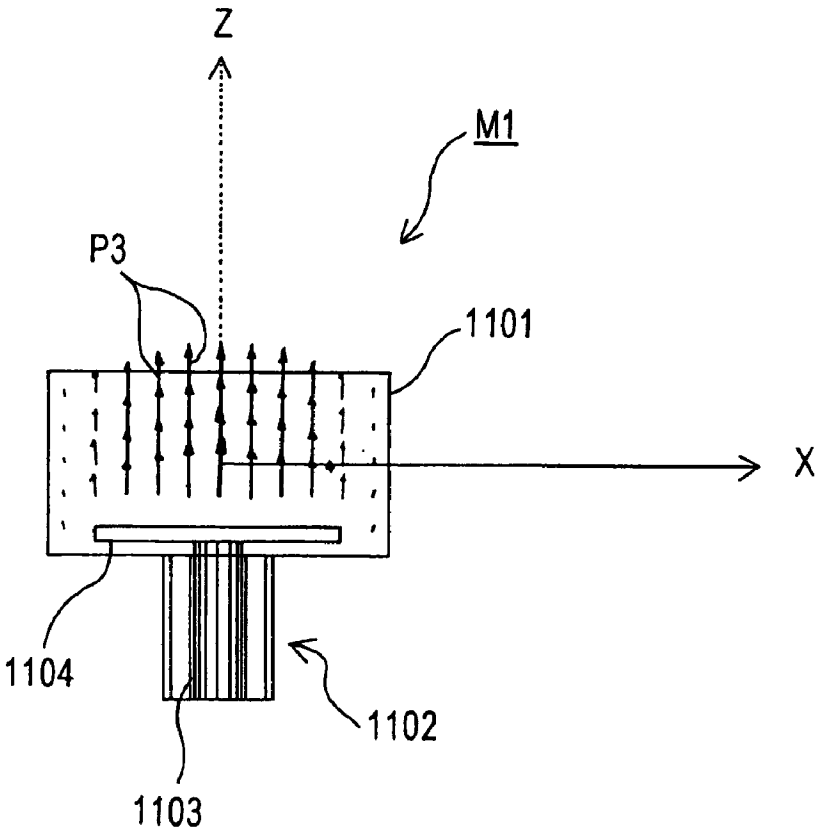
FIG. 37 is an analysis diagram showing electric lines of force in the XZ plane of the dielectric filter of FIG. 35.
Figure 38:
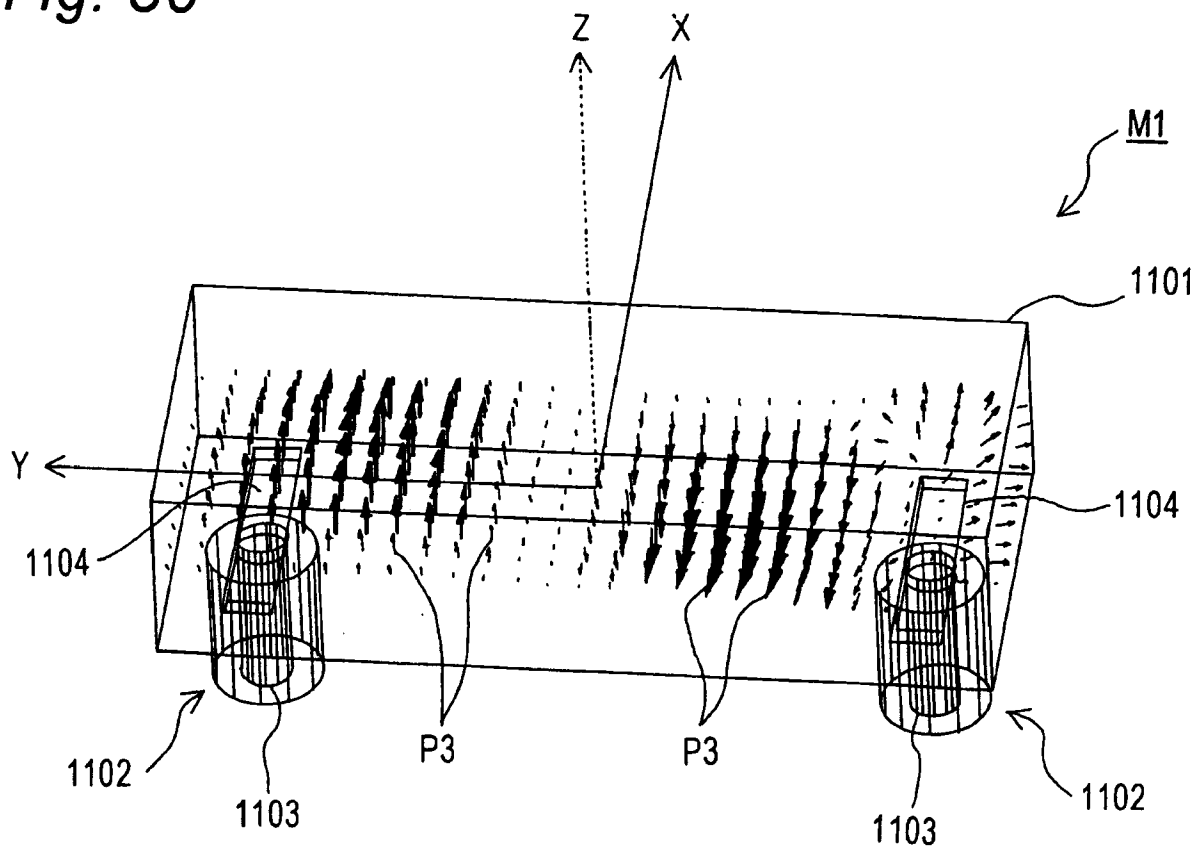
FIG. 38 is an analysis diagram showing electric lines of force in the XY plane of the dielectric filter of FIG. 35.
Figure 39:
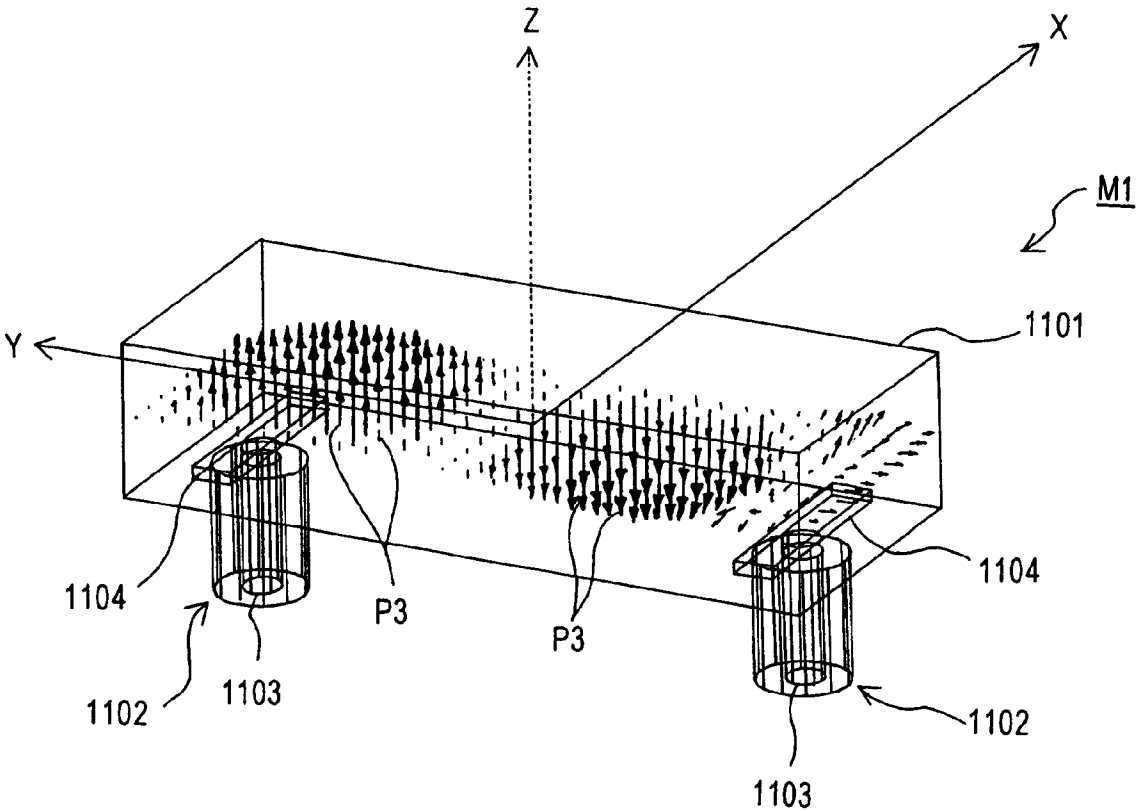
FIG. 39 is an analysis diagram showing three-dimensional electric lines of force in the dielectric filter of FIG. 35.
Figure 40:
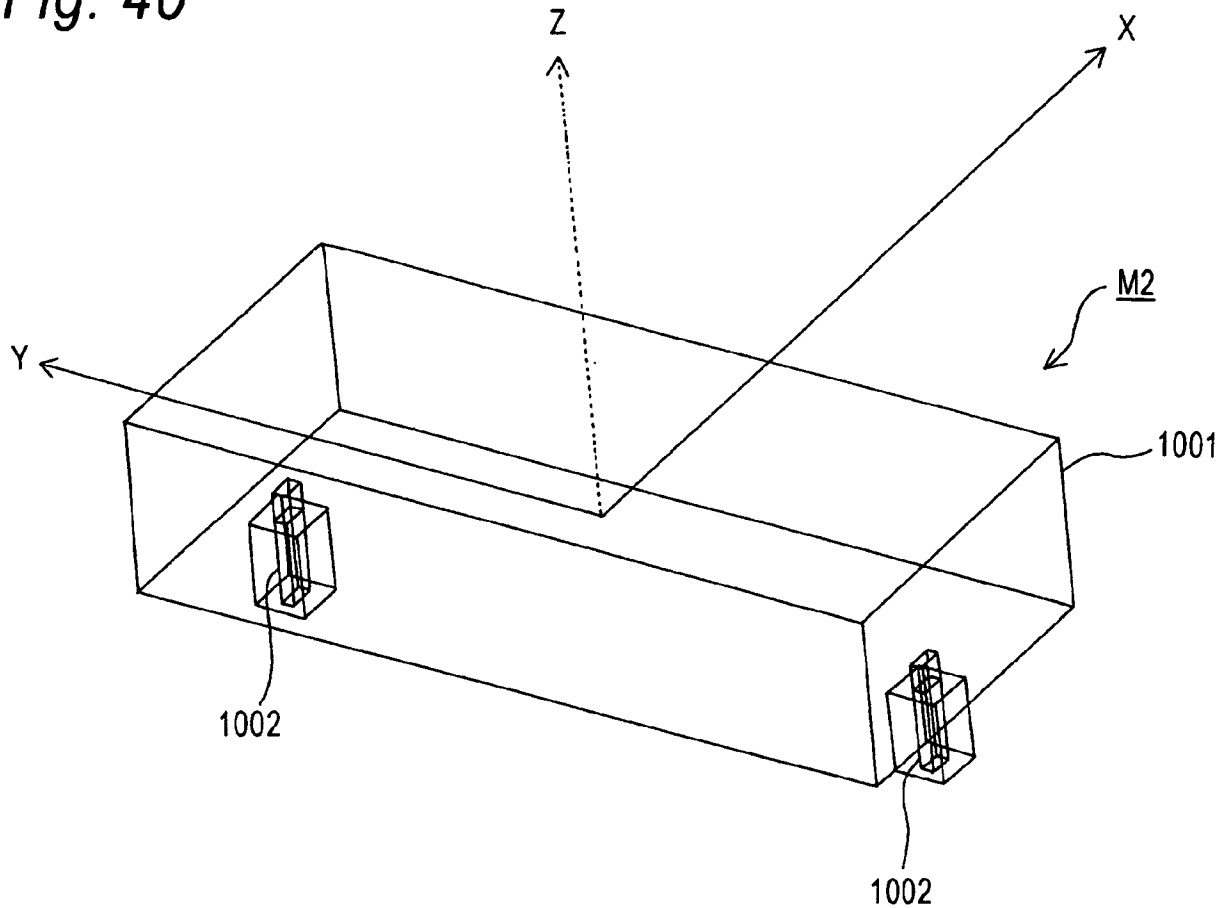
FIG. 40 is a schematic view showing an example model of the dielectric filter in which the rectangular electrodes according to one example of the fourth embodiment are employed.
Figure 41:
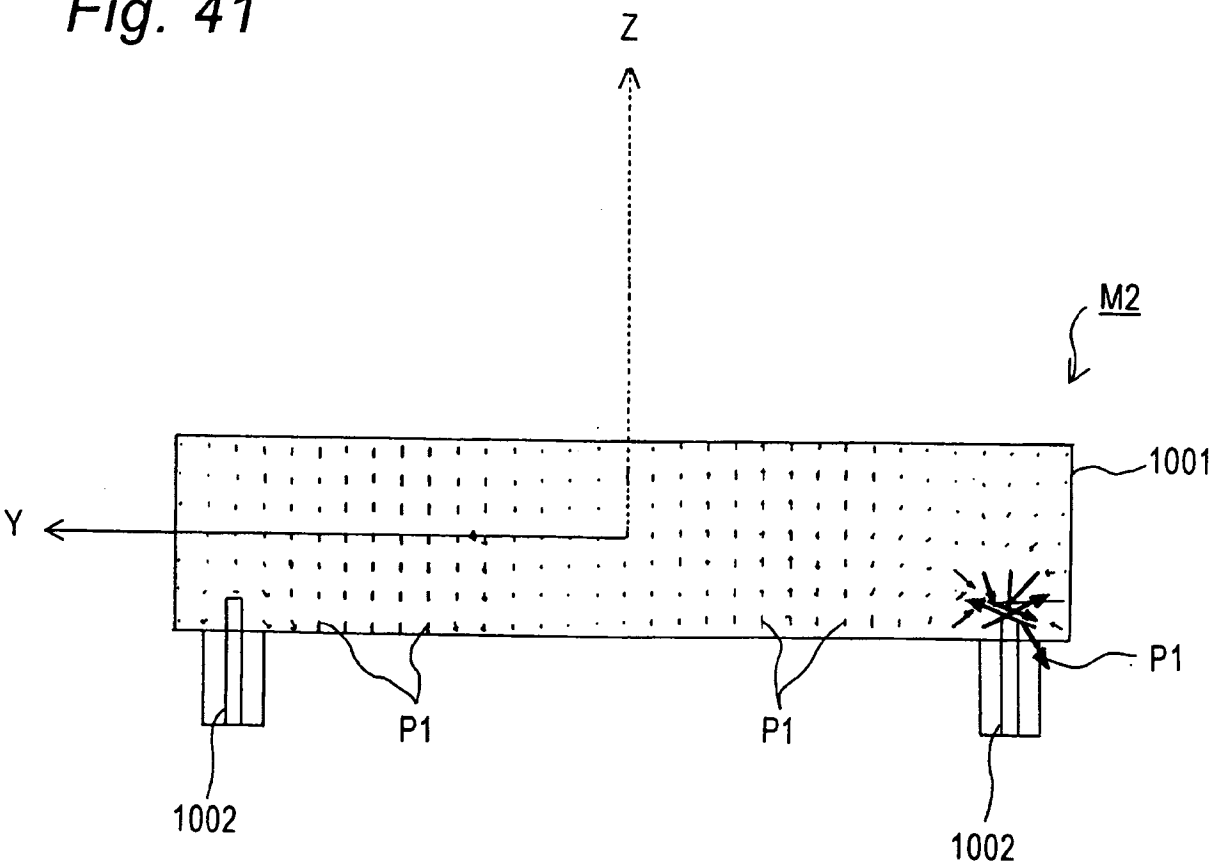
FIG. 41 is an analysis diagram showing electric lines of force in the YZ plane of the dielectric filter of FIG. 40.
Figure 42:
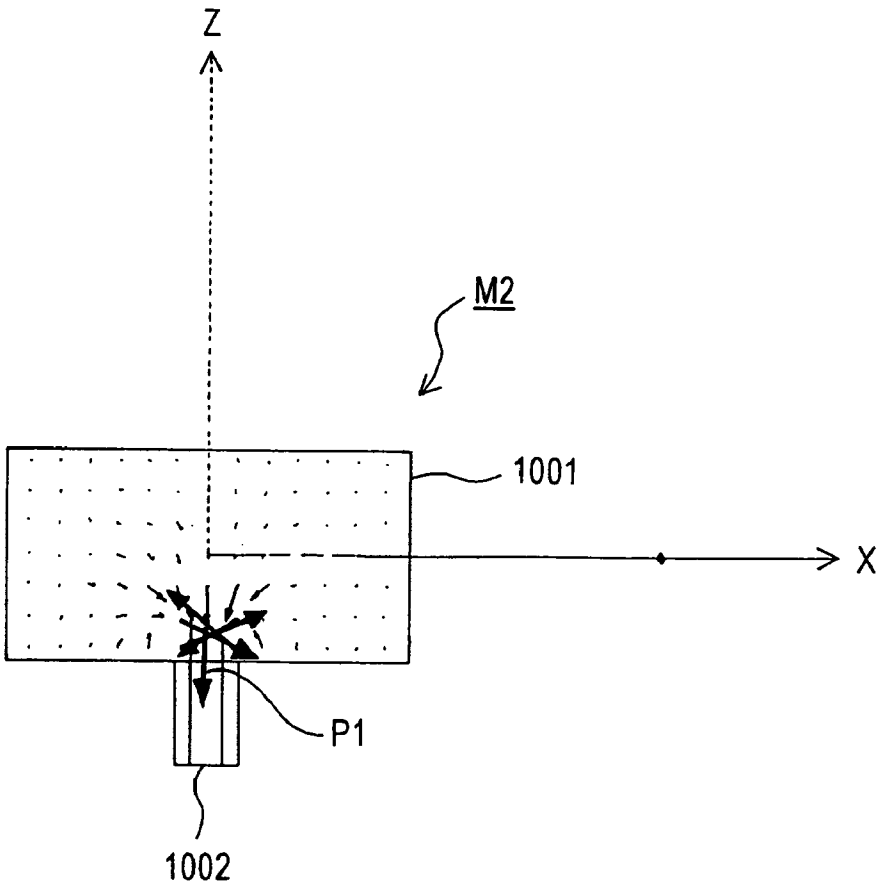
FIG. 42 is an analysis diagram showing electric lines of force in the XZ plane of the dielectric filter of FIG. 40.
Figure 43:
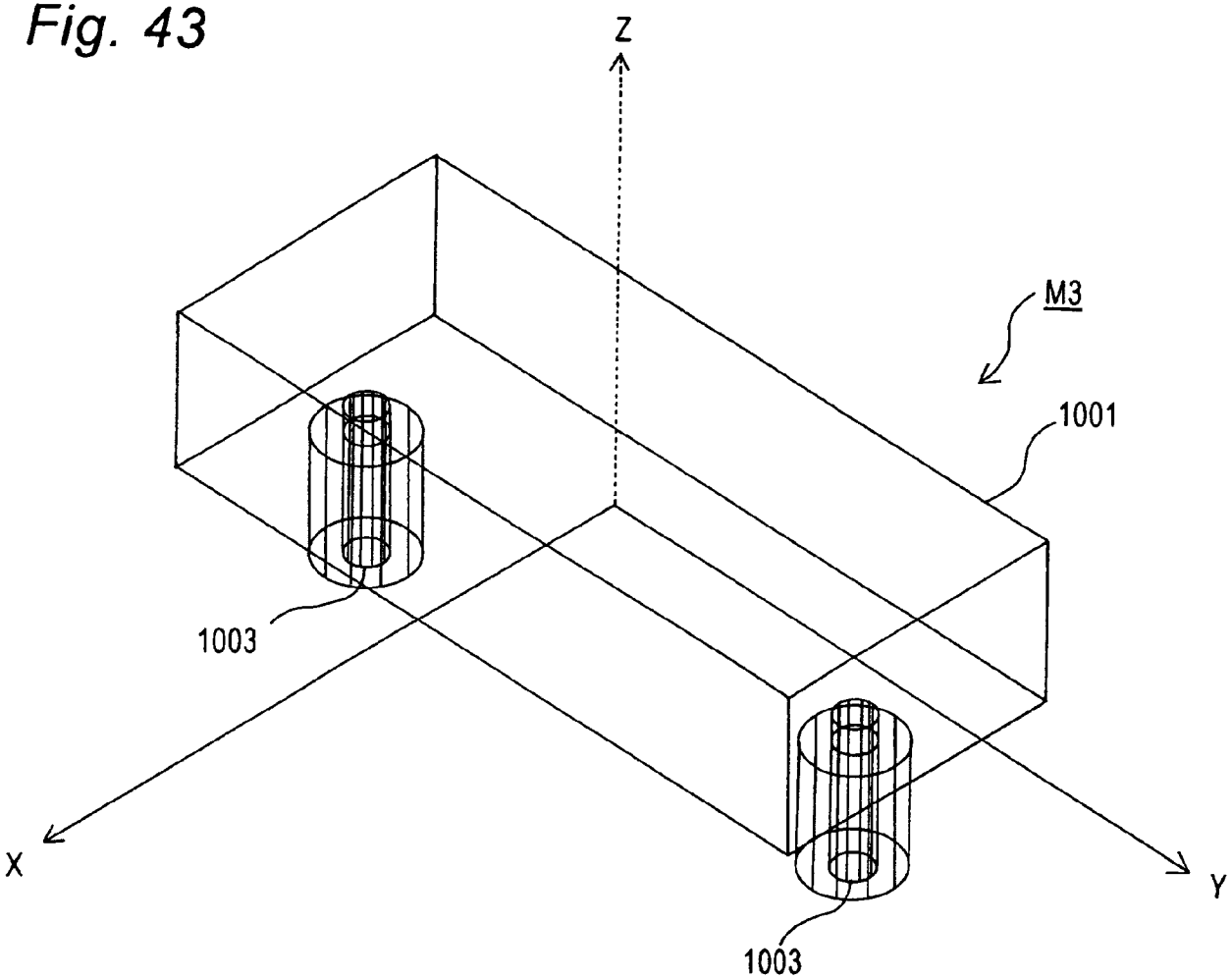
FIG. 43 is a schematic view showing an example model of the dielectric filter in which the columnar electrodes according to another example of the fourth embodiment are employed.
Figure 44:
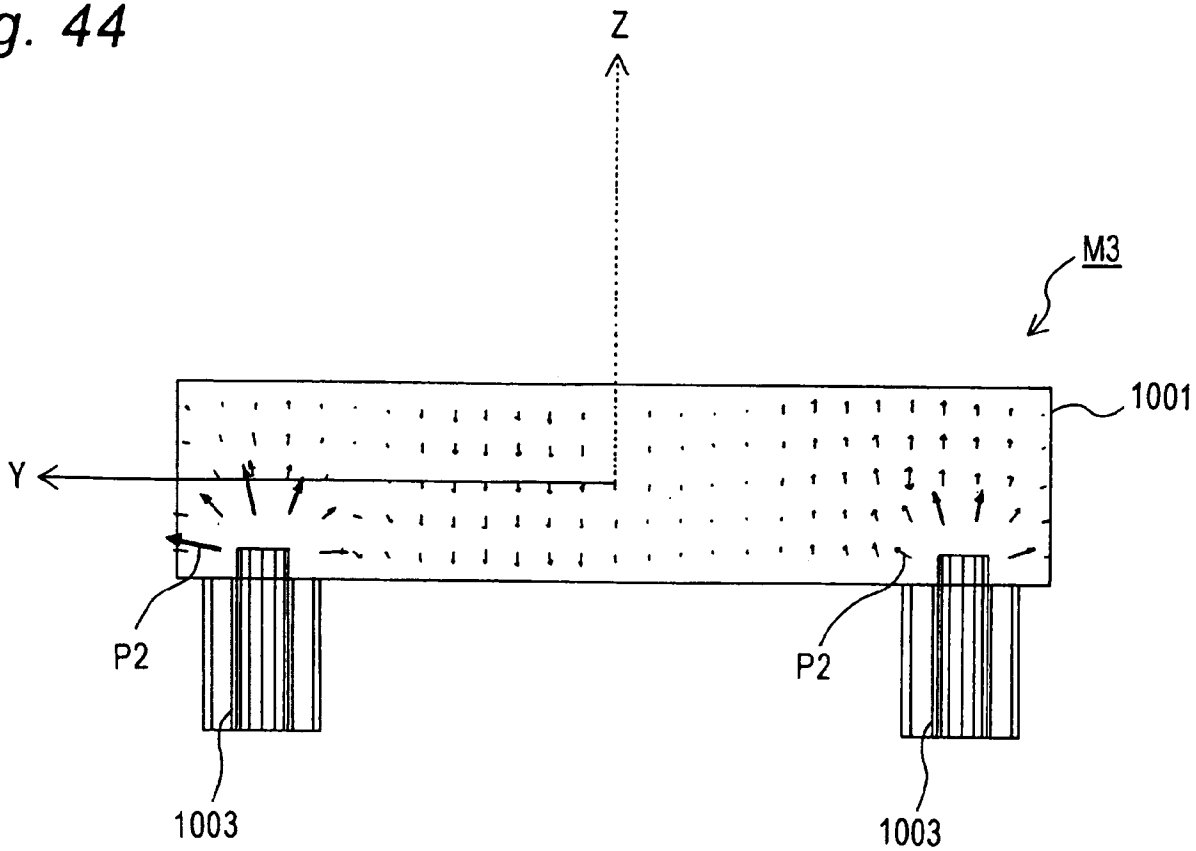
FIG. 44 is an analysis diagram showing electric lines of force in the YZ plane of the dielectric filter of FIG. 43.
Figure 45:
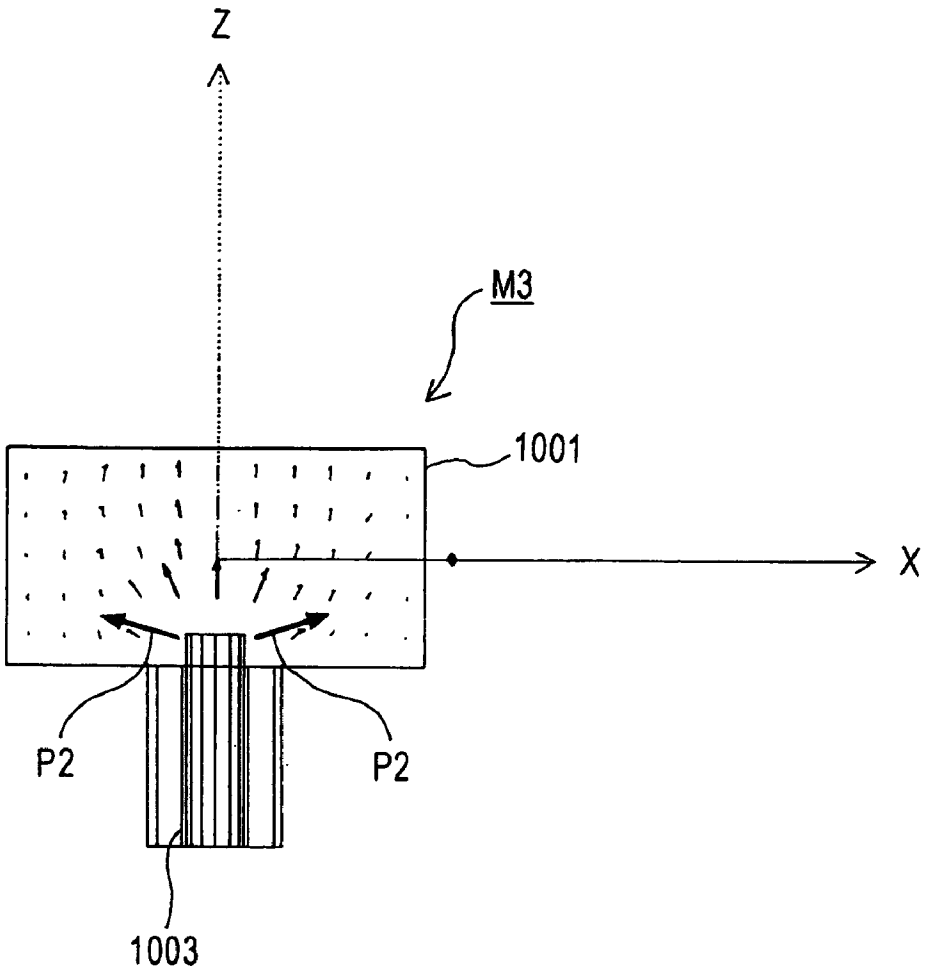
FIG. 45 is an analysis diagram showing electric lines of force in the XZ plane of the dielectric filter of FIG. 43.
Figure 46:
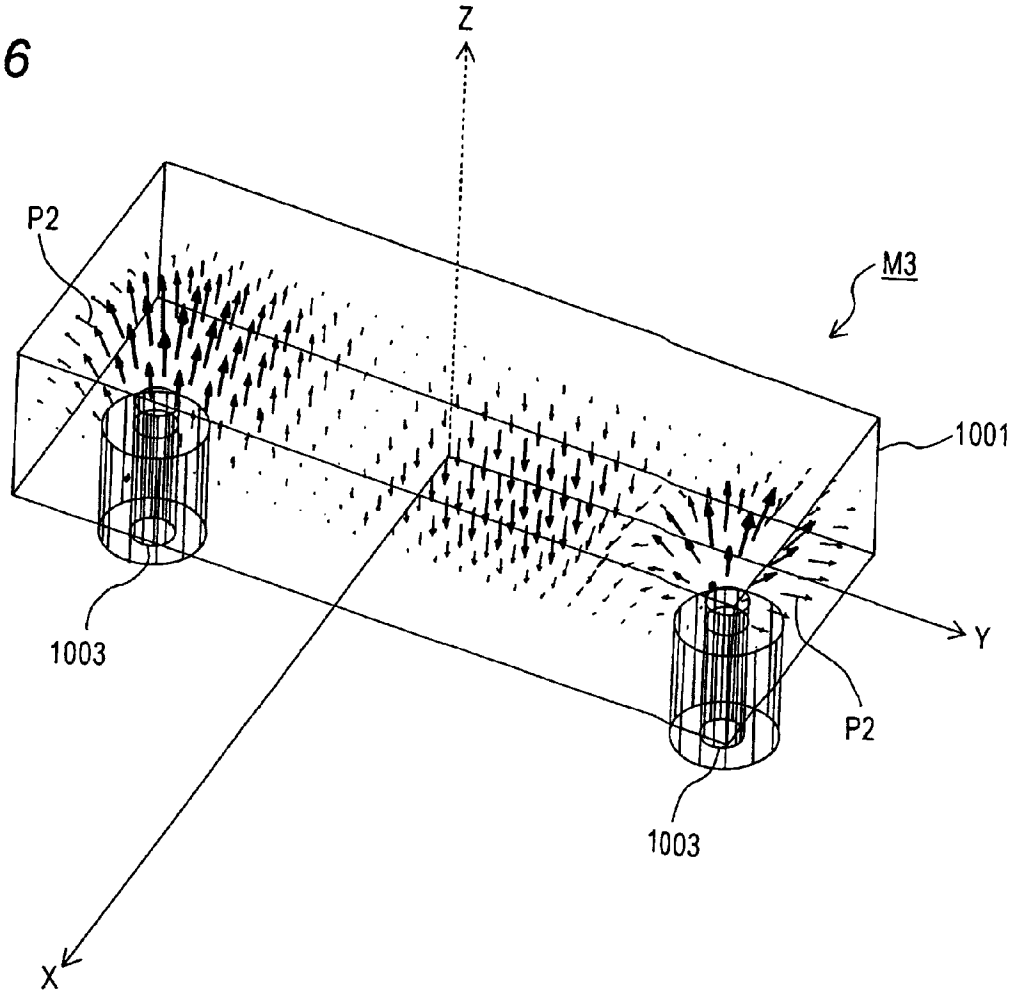
FIG. 46 is an analysis diagram showing electric lines of force in the XY plane of the dielectric filter of FIG. 43.

FIGS. 36 through 39 show the analytical results of the three-dimensional electric lines of force in the example model M1 of the electrode 1102 in the present fourth embodiment shown in the schematic view of FIG. 35. FIGS. 41 and 42 show the analytical results of the three-dimensional electric lines of force in the example model M2 of the rectangular electrode 1002 shown in the schematic view of FIG. 40. FIGS. 44 through 46 show the analytical results of the three-dimensional electric lines of force in the example model M3 of the columnar electrode 1003 shown in the schematic view of FIG. 43. In the schematic views and explanatory views of the analytical results, the direction in which the dielectric layers are layered in either the dielectric filter 1001 or 1101 is assumed to be the Y-axis, the direction along the axis of the columnar electrode portion 1103, the columnar electrode 1003 and the rectangular electrode 1002 is assumed to be the Z-axis, and the direction perpendicular to the Y-axis and the Z-axis is assumed to be the X-axis.

As shown in FIGS. 41 and 42, large disorder of the electric lines of force P1 can be confirmed in a YZ plane and a XZ plane in the vicinity of the end portion of the rectangular electrode 1002 of the model M2. Moreover, as shown in FIGS. 44 through 46, large disorder of the electric lines of force P2 can also be confirmed in the YZ plane, the XZ plane and an XY plane in the vicinity of the end portion of the columnar electrode 1003 of the model M3 although the disorder is somewhat improved in comparison with that of the model M2.

On the other hand, as shown in FIGS. 36 through 39, in the model M1 of the present fourth embodiment, the electric lines of force P3 of roughly uniform intensity are formed roughly upwardly in the Z-axis direction from the edge portions in the illustrated X-axis direction of the rectangular flat plate electrode portion 1104 of the electrode 1102, and it can be confirmed that large disorder of the electric lines of force P3 does not occur in the YZ plane, the XZ plane and the XY plane in comparison with those of the models M2 and M3.

The case where the electrode 1102 of the structure in which the rectangular flat plate electrode portion 1104 that has a roughly rectangular flat plate shape is connected to one end of the columnar electrode 1103 that has a roughly columnar shape is employed has been described above, the structure of the feeding electrode of the present fourth embodiment is not limited to only the case. Feeding electrodes according to modification examples of the present fourth embodiment are described below.

Figure 47:
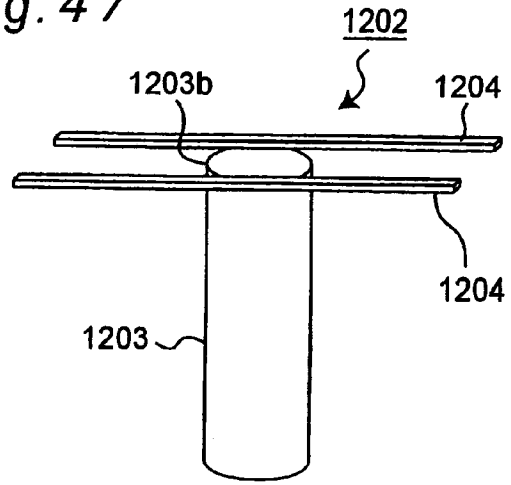
FIG. 47 is a schematic view of an electrode according to a modification example of the fourth embodiment.

First of all, FIG. 47 shows a schematic view showing the schematic construction of an electrode 1202 as one example of the feeding electrode of the modification example. As shown in FIG. 47, the electrode 1202 includes a columnar electrode portion 1203 that has the same shape as that of the columnar electrode 1103 owned by the electrode 1102 and wires 1204 of two rod members connected to an end portion 1203*b* that has a circular cross section on the upper side of the columnar electrode 1203. These two wires have, for example, a rectangular shape and are further arranged on mutually parallel two tangential lines of the circle of the end portion 1203*b*. Moreover, the wires 1204 are arranged roughly perpendicular to the axis of the columnar electrode portion 1103 and the direction in which the dielectric layers are layered in a dielectric filter (not shown).

By virtue of the electrode 1202 constructed of the wires 1204 and the columnar electrode 1203 as described above, the wires 1204 have the function of the rectangular flat plate electrode 1104 of the electrode 1102. Moreover, the wires 1204 can be regarded as constituted by extracting only the mutually opposing end portions in the direction in which the rectangular flat plate electrode portion 1104 extends.

Figure 48:
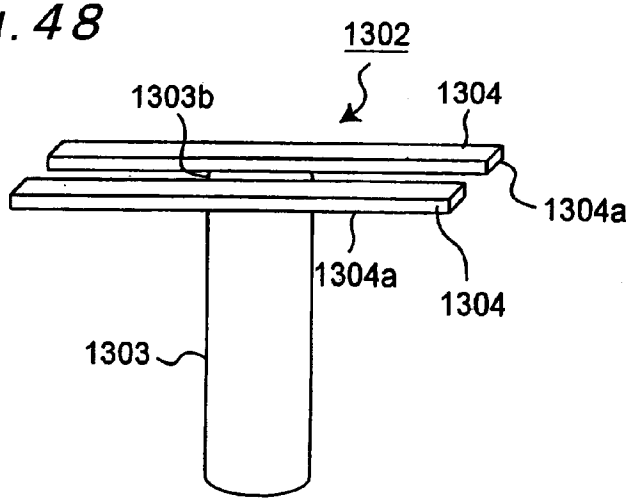
FIG. 48 is a schematic view of an electrode according to another modification example of the fourth embodiment.

Moreover, the construction of the feeding electrode that employs the two rectangular members is not limited only to the case where the two wires 1204 are employed. For example, it may be a case where rectangular members 1304 that have a cross section area larger than the wire 1204 are employed as the rectangular members like an electrode 1302 shown in FIG. 48. Even in the above case, the fact that the disorder of electric lines of force can be reduced like the electrode 1102 is not changed. It is noted that the above structure can be regarded as a structure in which the rectangular flat plate electrode portion 1103 of the electrode 1102 is divided into two parts in the direction in which the electrode portion extends. Moreover, even when the above structure is adopted, it is desirable that the outer end portions 1304*a* of the rectangular members 1304 are arranged in the mutually parallel tangential lines of the end portion 1303*b* of the columnar electrode portion 1303.

Figure 50:
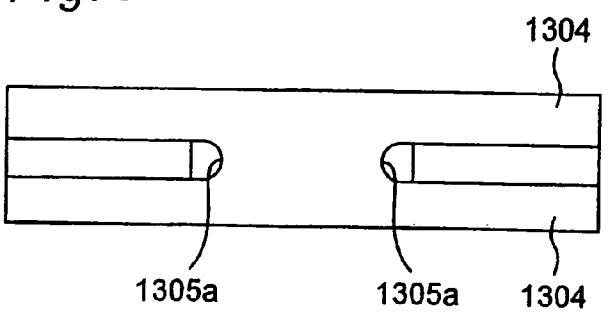
FIG. 50 is a schematic view of a case where semicircular end portions are formed at the joint portion of the electrode of FIG. 49.
Figure 49:
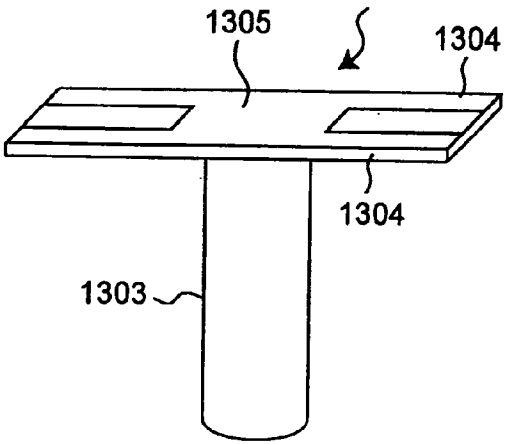
FIG. 49 is a schematic view of a case where in which the rectangular members of the electrode of FIG. 48 are joined together with a joint portion.

Moreover, as shown in FIG. 49, it may be a case where a joint portion 1305 that connects the rectangular members 1304 together is formed at the end portion 1303*b* of the columnar electrode 1303, constituting a flat-plate member. In the above case, there is an advantage that the rectangular members 1304 and the columnar electrode 1303 can easily be joined together even when the dielectric filter is reduced in size, and the manufacturing of a compacted dielectric filter can be facilitated. When the joint portion 1305 as described above is formed, its end portions 1305*a* should desirably have a semicircular shape in order to prevent unnecessary electric lines of force from occurring at the joint portion 1305 as shown in FIG. 50.

Although titanium is used as the material of the electrode in each of the embodiments, similar effects can be obtained even when gold, platinum (including the single metal substances and alloys of the platinum group such as palladium and iridium), copper or the like is used. Moreover, it is needless to say that the processing method is limited to neither one of the methods described in connection with the embodiments.

Moreover, similar effects can be obtained when the dielectric inner electrodes are formed of a conductive paste and used in combination with the metal of gold, platinum (including the single metal substances and alloys of the platinum group such as palladium and iridium), copper or the like.

Since it may be a case where the formation of the columnar electrode becomes very difficult when only the conductive paste is used, it is desirable to form the feeding electrode by combining a rectangular flat plate electrode portion with a metallic columnar electrode using the conductive paste.

It is to be noted that, by properly combining the arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A dielectric filter comprising:

a dielectric multilayer structure formed by layering alternately first and second dielectric layers which have different relative permittivities so that the first dielectric layers are located at both ends of the structure; and a shield portion that covers an outer surface of the dielectric multilayer structure, is made of a conductive material, and is placed so as to fit on the outer surface without interposition of a gap, wherein each of the dielectric layers has a thickness with inclinatorily changed.

2. The dielectric filter as defined in claim 1, wherein the thickness is inclinatorily changed so that a minimum value of the thickness is not smaller than 70% of a maximum value of the thickness.

* * * * *

UNITED STATES PATENT AND TRADEMARK OFFICE

CERTIFICATE OF CORRECTION

PATENT NO. : 7,057,479 B2
APPLICATION NO. : 11/165274
DATED : June 6, 2006
INVENTOR(S) : Hiroyuki Furuya et al.

It is certified that error appears in the above-identified patent and that said Letters Patent is hereby corrected as shown below:

On the title page of the Letters Patent:

Under section "(56) Reference Cited, OTHER PUBLICATIONS", delete " Akira ENOKIHARA et al., "26-GHz TM11 δ Rectangular-Mode Dielectric Resonator Filter," Technical Report of the RSSJ (RS01-16), March 13, 2003, pp 1-16, The Radiation Science Society of Japan (with English Translation)"

Signed and Sealed this

Tenth Day of April, 2007

JON W. DUDAS
*Director of the United States Patent and Trademark Office*